US009943733B2

(12) United States Patent
Franklin et al.

(10) Patent No.: US 9,943,733 B2
(45) Date of Patent: Apr. 17, 2018

(54) GOLF CLUBS AND GOLF CLUB HEADS

(71) Applicant: NIKE, Inc., Beaverton, OR (US)

(72) Inventors: David N. Franklin, Granbury, TX (US); Brian Kammerer, Fort Worth, TX (US); Eric A. Larson, Arlington, TX (US); Raymond J. Sander, Benbrook, TX (US); John T. Stites, Sallisaw, OK (US); Robert Boyd, Double Oak, TX (US)

(73) Assignee: NIKE, Inc., Beaverton, OR (US)

( * ) Notice: Subject to any disclaimer, the term of this patent is extended or adjusted under 35 U.S.C. 154(b) by 482 days.

(21) Appl. No.: 14/290,383

(22) Filed: May 29, 2014

(65) Prior Publication Data

US 2015/0343282 A1 Dec. 3, 2015

Related U.S. Application Data

(63) Continuation-in-part of application No. 13/308,079, filed on Nov. 30, 2011, now Pat. No. 9,072,948.

(51) Int. Cl.
*A63B 53/04* (2015.01)

(52) U.S. Cl.
CPC ..... *A63B 53/04* (2013.01); *A63B 53/0466* (2013.01); *A63B 2053/0433* (2013.01); *A63B 2053/0437* (2013.01); *A63B 2053/0495* (2013.01)

(58) Field of Classification Search
USPC ..... 473/324–350
See application file for complete search history.

(56) References Cited

U.S. PATENT DOCUMENTS 537,927 A 4/1895 Rivoire
546,540 A 9/1895 Kennedy
1,219,417 A 3/1917 Vories
(Continued)

FOREIGN PATENT DOCUMENTS

FR 2672226 A1 8/1992
GB 2374539 A 10/2002
(Continued)

OTHER PUBLICATIONS

Sep. 11, 2015—(WO) ISR & WO—App. No. PCT/US15/032665.
(Continued)

*Primary Examiner* — Alvin Hunter
(74) *Attorney, Agent, or Firm* — Banner & Witcoff, Ltd.

(57) ABSTRACT

A ball striking device has a head with a body member having a face having a striking surface configured for striking a ball, a crown portion and a sole portion connected to the face and extending rearward from the face, where the body member has a void extending inwardly from a rear periphery of the body member, and a rear member connected to the body member and received within the void, such that the rear member forms portions of a crown and a sole of the head. A connection member connects the rear member to the body member to form a joint between the rear member and the body member. A resilient member separates the rear member from the body member, and the resilient member engages the rear member and the body member within the void and is configured to transfer momentum between the rear member and the body member.

27 Claims, 13 Drawing Sheets

(56) References Cited

U.S. PATENT DOCUMENTS 1,222,770 A 4/1917 Kaye
1,429,569 A 9/1922 Craig
1,463,533 A * 7/1923 Kurz, Jr. ..... A63B 53/04 473/342
1,506,733 A 9/1924 Bugbee
1,509,733 A 9/1924 Langford
1,568,485 A 1/1926 Turney
1,594,850 A 8/1926 Perkins
1,867,103 A 7/1932 Schavoir
2,171,383 A 8/1939 Wettlaufer
2,217,338 A 10/1940 Fuller
2,222,534 A 11/1940 Henry
2,305,270 A 12/1942 Nilson
2,329,313 A 9/1943 Winter
2,429,351 A 10/1947 Fetterolf
2,455,150 A 11/1948 Verderber
2,503,506 A * 4/1950 Miller ..... A63B 69/3685 473/251
2,520,702 A 8/1950 Verderber
2,571,970 A 10/1951 Verderber
2,593,368 A 4/1952 Verderber
2,777,694 A 1/1957 Winter
3,214,169 A 10/1965 Rupnow
3,305,235 A 2/1967 Williams, Jr.
3,516,674 A * 6/1970 Scarborough ..... A63B 53/0487 473/311
3,519,271 A 7/1970 Smith
3,601,399 A 8/1971 Agens et al.
3,791,647 A 2/1974 Verderber
3,840,231 A 10/1974 Moore
3,980,301 A 9/1976 Smith
4,121,832 A * 10/1978 Ebbing ..... A63B 53/007 473/288
D267,965 S 2/1983 Kobayashi
4,632,400 A 12/1986 Boone
4,792,140 A 12/1988 Yamaguchi et al.
4,811,950 A * 3/1989 Kobayashi ..... A63B 53/04 473/335
4,842,280 A 6/1989 Hilton
4,871,174 A 10/1989 Kobayashi
4,878,666 A 11/1989 Hosoda
4,884,808 A * 12/1989 Retzer ..... A63B 53/04 473/288
4,927,144 A 5/1990 Stormon
4,928,972 A 5/1990 Nakanishi et al.
4,984,800 A * 1/1991 Hamada ..... A63B 53/04 264/241
5,154,425 A 10/1992 Niskanen et al.
5,183,255 A 2/1993 Antonious
5,275,413 A 1/1994 Sprague
5,290,036 A * 3/1994 Fenton ..... A63B 53/04 273/DIG. 8
5,292,123 A 3/1994 Schmidt, Jr. et al.
5,297,803 A 3/1994 Solheim
5,299,807 A 4/1994 Hutin
5,344,151 A 9/1994 Anderson et al.
5,346,213 A 9/1994 Yamada
5,390,920 A * 2/1995 Nickum ..... A63B 53/06 473/246
5,393,056 A 2/1995 Richardson
5,398,929 A 3/1995 Kitaichi
5,407,202 A 4/1995 Igarashi
5,413,337 A 5/1995 Goodman et al.
5,429,356 A * 7/1995 Dingle ..... A63B 53/02 473/251
5,433,441 A 7/1995 Olsen et al.
5,435,551 A 7/1995 Chen
5,439,223 A 8/1995 Kobayashi
5,447,307 A 9/1995 Antonious
5,472,201 A 12/1995 Aizawa et al.
5,485,997 A 1/1996 Schmidt et al.
5,492,327 A 2/1996 Biafore, Jr.
5,516,097 A 5/1996 Huddleston
5,518,240 A * 5/1996 Igarashi ..... A63B 53/0466 473/345
5,518,243 A * 5/1996 Redman ..... A63B 53/04 473/334
5,540,436 A 7/1996 Boone
D375,130 S 10/1996 Hlinka et al.
5,564,705 A 10/1996 Kobayashi et al.
5,586,947 A 12/1996 Hutin
5,601,498 A 2/1997 Antonious
5,611,740 A 3/1997 Nagamoto
D378,770 S 4/1997 Hlinka et al.
5,632,695 A 5/1997 Hlinka et al.
5,643,111 A 7/1997 Igarashi
5,649,872 A 7/1997 Antonious
5,658,208 A 8/1997 Shimasaki
5,674,132 A 10/1997 Fisher
5,676,606 A * 10/1997 Schaeffer ..... A63B 53/0487 473/340
5,692,972 A 12/1997 Langslet
5,697,855 A 12/1997 Aizawa
5,716,290 A 2/1998 Baker et al.
5,749,794 A 5/1998 Kobayashi et al.
5,755,625 A 5/1998 Jackson
5,772,525 A 6/1998 Klein
5,772,526 A 6/1998 Hano
5,803,825 A * 9/1998 Hamilton ..... A63B 53/0487 473/252
5,820,481 A * 10/1998 Raudman ..... A63B 53/0487 473/313
5,833,551 A 11/1998 Vincent et al.
5,851,157 A 12/1998 Koide et al.
5,863,257 A * 1/1999 Busnardo ..... A63B 53/02 473/246
5,890,976 A 4/1999 Anderson
5,930,887 A 8/1999 Tomita et al.
5,931,741 A 8/1999 Fenton, Jr.
5,993,324 A 11/1999 Gammil
6,001,028 A 12/1999 Tang et al.
6,001,030 A * 12/1999 Delaney ..... A63B 53/0487 473/329
6,027,415 A 2/2000 Takeda
6,030,295 A 2/2000 Takeda
6,080,068 A 6/2000 Takeda
6,095,931 A * 8/2000 Hettinger ..... A63B 53/0487 473/341
6,159,109 A 12/2000 Langslet
6,162,133 A * 12/2000 Peterson ..... A63B 53/04 473/345
6,171,204 B1 1/2001 Starry
6,176,791 B1 1/2001 Wright
6,186,903 B1 2/2001 Beebe et al.
6,206,788 B1 3/2001 Krenzler
6,217,461 B1 * 4/2001 Galy ..... A63B 53/04 473/328
6,270,423 B1 * 8/2001 Webb ..... A63B 53/0487 473/226
6,299,546 B1 10/2001 Wang
6,302,807 B1 10/2001 Rohrer
6,328,661 B1 12/2001 Helmstetter et al.
6,332,848 B1 * 12/2001 Long ..... A63B 53/04 473/328
6,348,009 B1 2/2002 Dischler
6,386,987 B1 5/2002 Lejeune, Jr.
6,428,423 B1 8/2002 Merko
6,431,997 B1 * 8/2002 Rohrer ..... A63B 53/04 473/324
6,440,009 B1 * 8/2002 Guibaud ..... A63B 53/04 473/334
6,443,857 B1 9/2002 Chuang
6,478,690 B2 * 11/2002 Helmstetter ..... A63B 53/0487 473/324
6,491,593 B2 12/2002 Takeda
6,514,153 B2 2/2003 Miyamoto et al.
6,514,155 B1 2/2003 Sheets
6,524,197 B2 2/2003 Boone
6,533,679 B1 3/2003 McCabe et al.
6,558,271 B1 5/2003 Beach et al.
6,625,848 B1 9/2003 Schneider

(56) References Cited

U.S. PATENT DOCUMENTS 6,648,773 B1 * 11/2003 Evans ..... A63B 53/0466 473/342
6,676,533 B1 1/2004 Hsien
6,743,112 B2 * 6/2004 Nelson ..... A63B 53/0487 473/251
6,769,998 B2 8/2004 Clausen et al.
6,811,496 B2 11/2004 Wahl et al.
6,872,153 B2 3/2005 Gilbert et al.
6,875,124 B2 4/2005 Gilbert et al.
6,899,636 B2 5/2005 Finn
6,932,717 B2 8/2005 Hou et al.
6,991,555 B2 1/2006 Reese
7,025,692 B2 4/2006 Erickson et al.
7,048,646 B2 5/2006 Yamanaka et al.
7,070,513 B2 7/2006 Takeda et al.
7,074,132 B1 7/2006 Finn
7,083,525 B2 * 8/2006 Pond ..... A63B 53/04 273/DIG. 14
7,108,609 B2 9/2006 Stites et al.
7,128,664 B2 * 10/2006 Onoda ..... A63B 53/0466 473/345
7,232,377 B2 6/2007 Gilbert et al.
7,244,188 B2 7/2007 Best
7,281,985 B2 10/2007 Galloway
7,297,072 B2 * 11/2007 Meyer ..... A63B 60/42 473/332
7,371,190 B2 5/2008 Gilbert et al.
7,410,427 B2 8/2008 Imamoto et al.
7,410,428 B1 * 8/2008 Dawson ..... A63B 53/0466 473/345
7,419,439 B1 9/2008 Aleamoni
7,431,662 B2 * 10/2008 Tucker, Sr. ..... A63B 53/06 473/288
7,452,283 B2 11/2008 Hettinger et al.
7,473,186 B2 * 1/2009 Best ..... A63B 53/0487 473/329
7,530,902 B2 5/2009 Nakamura
7,540,810 B2 * 6/2009 Hettinger ..... A63B 53/0487 473/331
7,559,850 B2 7/2009 Gilbert et al.
7,566,276 B2 7/2009 Billings
7,575,523 B2 8/2009 Yokota
7,588,503 B2 * 9/2009 Roach ..... A63B 53/047 473/332
7,601,077 B2 * 10/2009 Serrano ..... A63B 53/0487 473/332
7,641,569 B2 1/2010 Best et al.
7,651,409 B1 * 1/2010 Mier ..... A63B 53/007 473/330
7,677,987 B2 3/2010 Hilton
D613,357 S 4/2010 Utz
7,717,807 B2 * 5/2010 Evans ..... A63B 53/0466 473/344
7,740,545 B2 6/2010 Cameron
7,753,809 B2 * 7/2010 Cackett ..... A63B 53/0466 473/345
7,794,334 B2 9/2010 Hilton
7,798,914 B2 9/2010 Noble et al.
7,854,667 B2 12/2010 Gillig
7,887,432 B2 2/2011 Jones et al.
7,892,106 B2 2/2011 Matsunaga
7,934,999 B2 5/2011 Cackett et al.
7,997,999 B2 8/2011 Roach et al.
8,007,371 B2 * 8/2011 Breier ..... A63B 53/0466 473/342
8,057,322 B2 11/2011 Wallans
8,092,318 B2 * 1/2012 Oldknow ..... A63B 53/04 473/329
8,177,664 B2 5/2012 Horii et al.
8,206,241 B2 6/2012 Boyd et al.
8,210,961 B2 7/2012 Finn et al.
8,272,976 B2 9/2012 DAgostino
8,333,668 B2 12/2012 De La Cruz et al.
8,382,604 B2 2/2013 Billings
8,475,292 B2 7/2013 Rahrig et al.
8,517,673 B2 8/2013 Ambrosy et al.
8,517,851 B2 8/2013 Cackett et al.
8,523,698 B2 * 9/2013 Hotaling ..... A63B 53/04 473/251
8,535,171 B2 9/2013 McGinnis, Jr.
8,608,589 B2 * 12/2013 Ferguson ..... A63B 53/0466 473/334
8,657,702 B2 * 2/2014 Boyd ..... A63B 53/0466 473/334
8,702,533 B2 * 4/2014 Evans ..... A63B 53/0466 473/334
8,771,098 B2 * 7/2014 Hilton ..... A63B 53/08 473/251
8,900,064 B2 12/2014 Franklin
8,956,244 B1 2/2015 Westrum et al.
8,979,668 B2 * 3/2015 Nakamura ..... A63B 53/0487 473/329
9,028,342 B2 * 5/2015 Stites ..... A63B 53/0466 473/328
9,033,817 B2 * 5/2015 Snyder ..... A63B 53/047 156/242
9,072,948 B2 * 7/2015 Franklin ..... A63B 53/04
9,089,747 B2 7/2015 Boyd et al.
9,101,805 B2 8/2015 Stites et al.
9,101,808 B2 8/2015 Stites et al.
9,186,546 B2 * 11/2015 Boyd ..... A63B 24/0003
2002/0025859 A1 2/2002 Finn
2002/0169036 A1 * 11/2002 Boone ..... A63B 53/0466 473/346
2003/0032499 A1 2/2003 Wahl et al.
2003/0236134 A1 12/2003 Nishitani
2004/0018886 A1 1/2004 Burrows
2005/0049078 A1 3/2005 Yamanaka et al.
2005/0192116 A1 9/2005 Imamoto
2005/0272527 A1 * 12/2005 Sugimoto ..... A63B 53/0466 473/345
2006/0148585 A1 7/2006 Vinton
2006/0154746 A1 7/2006 Hagood et al.
2006/0154747 A1 7/2006 Beach
2006/0172816 A1 8/2006 Johnson
2007/0129165 A1 6/2007 Matsunaga et al.
2007/0142123 A1 6/2007 Franklin
2007/0259735 A1 11/2007 Beckman
2007/0298904 A1 12/2007 Dworzan
2008/0004132 A1 1/2008 Lin et al.
2008/0009360 A1 1/2008 Purtill
2008/0085781 A1 4/2008 Iwahori
2009/0298613 A1 12/2009 Hirsch et al.
2010/0029409 A1 2/2010 Noble et al.
2010/0167836 A1 7/2010 Horii et al.
2010/0184527 A1 7/2010 Demkowski et al.
2010/0203983 A1 8/2010 Stites
2010/0261546 A1 * 10/2010 Nicodem ..... A63B 53/0487 473/340
2011/0021287 A1 1/2011 Tucker, Sr. et al.
2011/0034270 A1 * 2/2011 Wahl ..... A63B 53/047 473/342
2011/0081987 A1 4/2011 Gillig
2011/0086722 A1 4/2011 Oldknow et al.
2011/0224017 A1 9/2011 Thomas et al.
2011/0275446 A1 11/2011 Rahrig et al.
2012/0108357 A1 5/2012 Nakamura
2012/0122607 A1 5/2012 Reinberg
2013/0095953 A1 4/2013 Hotaling et al.
2013/0109501 A1 5/2013 Stites et al.
2013/0137533 A1 5/2013 Franklin et al.
2013/0157774 A1 6/2013 Chen
2013/0178307 A1 7/2013 Wicketts
2013/0203522 A1 8/2013 Franklin et al.
2013/0281227 A1 10/2013 Roach et al.
2014/0045607 A1 2/2014 Hilton
2014/0187346 A1 7/2014 Beno et al.
2014/0256463 A1 9/2014 Knight
2015/0080147 A1 3/2015 Cameron
2015/0297959 A1 10/2015 Lee

(56) References Cited

U.S. PATENT DOCUMENTS

| | | | |
|---|---|---|---|
| 2015/0335966 | A1 | 11/2015 | Cameron |
| 2016/0129320 | A1 | 5/2016 | Dolezel et al. |
| 2016/0129321 | A1 | 5/2016 | Dolezel |

FOREIGN PATENT DOCUMENTS

| | | | | |
|---|---|---|---|---|
| JP | 08280854 | A | * | 10/1996 |
| JP | H09000666 | | | 1/1997 |
| JP | 09047531 | A | * | 2/1997 |
| JP | 09215786 | A | * | 8/1997 |
| JP | H09215785 | A | | 8/1997 |
| JP | H09276455 | A | | 10/1997 |
| JP | 10201886 | A | * | 8/1998 |
| JP | 10234890 | A | * | 9/1998 |
| JP | H1111412 | A | | 1/1999 |
| JP | H1157082 | A | | 3/1999 |
| JP | H11137731 | A | | 5/1999 |
| JP | H11169493 | A | | 6/1999 |
| JP | H11178955 | A | | 7/1999 |
| JP | H11244431 | A | | 9/1999 |
| JP | 11299937 | A | * | 11/1999 |
| JP | 2000197718 | A | * | 7/2000 |
| JP | 2000288132 | A | * | 10/2000 |
| JP | 2000350798 | A | * | 12/2000 |
| JP | 2001054599 | A | * | 2/2001 |
| JP | 2003265657 | A | * | 9/2003 |
| JP | 2004141350 | A | * | 5/2004 |
| JP | 2005131280 | A | | 5/2005 |
| JP | 2005211613 | A | | 8/2005 |
| JP | 2005305178 | A | | 11/2005 |
| JP | 2006000435 | A | | 1/2006 |
| JP | 2006280586 | A | * | 10/2006 |
| JP | 2006296568 | A | * | 11/2006 |
| JP | 2008006225 | A | * | 1/2008 |
| JP | 2008173293 | A | * | 7/2008 |
| JP | 2009297210 | A | | 12/2009 |
| JP | 2010148565 | A | | 7/2010 |
| JP | 2010148652 | A | | 7/2010 |
| JP | 2010154887 | A | | 7/2010 |
| JP | 2010273804 | A | * | 12/2010 |
| WO | 9920358 | A1 | | 4/1999 |
| WO | 2005007249 | A2 | | 1/2005 |
| WO | WO 2010019636 | A2 | * | 2/2010 ..... A63B 53/04 |
| WO | 2013082277 | A1 | | 6/2013 |

OTHER PUBLICATIONS

Feb. 27, 2013—(WO) ISR & WO—App. No. PCT/US12/067050.
Oct. 28, 2015—(WO) ISR & WO—App. No. PCT/US15/033371.
Sep. 28, 2015—(WO) International Search Report and Written Opinion—App PCT/US2015/032819.
Jul. 12, 2016—(WO) ISR & WO—App. No. PCT/US15/032821.
Oct. 10, 2016—(WO) ISR & WO—App. No. PCT/US16/033014.
Sep. 29, 2016—(WO) International Search Report and Written Opinion—App PCT/US2016/033025.
Oct. 28, 2015—(WO) ISR & WO—App. No. PCT/US15/033128.

* cited by examiner

GOLF CLUBS AND GOLF CLUB HEADS

CROSS REFERENCE TO RELATED APPLICATION

This application claims priority to, and is a continuation-in-part of, co-pending U.S. patent application Ser. No. 13/308,079, filed Nov. 30, 2011.

TECHNICAL FIELD

The invention relates generally to ball striking devices, such as golf clubs and golf club heads, utilizing features for transfer of energy and/or momentum. Certain aspects of this invention relate to golf club heads having a rear member configured to transfer energy and/or momentum to the face upon an impact on the face.

BACKGROUND

Golf clubs and many other ball striking devices can encounter undesirable effects when the ball being struck impacts the ball striking head away from the optimum location, which may be referred to as an "off-center impact." In a golf club head, this optimum location is, in many cases, aligned laterally and/or vertically with the center of gravity (CG) of the head. Even slightly off-center impacts can sometimes significantly affect the performance of the head, and can result in reduced velocity and/or energy transfer to the ball, inconsistent ball flight direction and/or spin caused by twisting of the head, increased vibration that can produce undesirable sound and/or feel, and other undesirable effects. Technologies that can reduce or eliminate some or all of these undesirable effects could have great usefulness in golf club heads and other ball striking devices.

The present devices and methods are provided to address at least some of the problems discussed above and other problems, and to provide advantages and aspects not provided by prior ball striking devices of this type. A full discussion of the features and advantages of the present invention is deferred to the following detailed description, which proceeds with reference to the accompanying drawings.

BRIEF SUMMARY

The following presents a general summary of aspects of the invention in order to provide a basic understanding of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of the disclosure relate to ball striking devices, such as wood-type golf clubs or other golf clubs, with a head that includes a body member that has a face having a striking surface configured for striking a ball, a crown portion and a sole portion connected to the face and extending rearward from the face, where the body member has a void extending inwardly from a rear periphery of the body member, and a rear member connected to the body member and received within the void, such that the rear member forms portions of a crown and a sole of the head. A connection member connects the rear member to the body member to form a joint between the rear member and the body member. A resilient member separates the rear member from the body member, and the resilient member engages the rear member and the body member within the void and is configured to transfer momentum between the rear member and the body member.

According to one aspect, the void is angular in shape, such that the void has a vertex proximate a center of the body member and increases in width from the vertex to the rear periphery, and wherein the rear member is wedge-shaped to complement the shape of the void. As various examples, the void defines an angle of approximately 30°, 45°, or 60°. Additionally, the connection member may be connected to the body member proximate the vertex, such that the joint is positioned proximate the vertex. In such a configuration the body member may further include a support member extending from the crown portion to the sole portion proximate the vertex of the void, such that the support member is exposed within the void, and wherein the connection member may connect the rear member to the support member. Further, the rear member may be connected to the body member at a crown end of the support member and at a sole end of the support member.

According to another aspect, the rear member is connected to the body member at the crown portion and at the sole portion.

Additional aspects of the disclosure relate to ball striking devices, such as wood-type golf clubs or other golf clubs, with a head that includes a body member that has a face having a striking surface configured for striking a ball, and a crown portion and a sole portion connected to the face and extending rearward from the face, a resilient member engaged with a rear portion of the body member, and a rear member connected to the rear portion of the body member and engaged with the resilient member, such that the resilient member separates the rear member from the body member. A connection member connects the rear member to the body member to form a joint between the rear member and the body member, and the resilient member is configured to transfer momentum between the rear member and the body member.

According to one aspect, the rear member is connected to the body member at the crown portion and at the sole portion.

According to another aspect, the body member further includes an internal support member extending from the crown portion to the sole portion, such that the connection member connects the rear member to the support member. In one configuration, the head may include at least one connection member, and the at least one connection member may connect the rear member to the body member at a crown end of the support member and at a sole end of the support member, such that the rear member forms portions of a crown and a sole of the head. Additionally, the at least one connection member may include a pin extending from the crown end to the sole end of the support member, such that the pin connects to the rear member at the crown end and the sole end of the support member. In another configuration, the sole end of the support member may be positioned closer to the face than the crown end of the support member, such that the support member angles downward and toward the face from the crown end to the sole end.

According to a further aspect, the head also includes a void extending inwardly from a rear periphery of the body member, such that the rear member is received within the void.

Further aspects of the disclosure relate to ball striking devices, such as wood-type golf clubs or other golf clubs, with a head that includes a body member that has a face having a striking surface configured for striking a ball and a crown portion and a sole portion connected to the face and extending rearward from the face, a resilient member engaged with a rear portion of the body member, and a rear member connected to the rear portion of the body member and engaged with the resilient member, such that the resilient member separates the rear member from the body member. An engagement member engages the rear member and the body member to form a sole area of rigid engagement between the rear member and the body member. The resilient member is configured to transfer momentum between the rear member and the body member.

According to one aspect, the engagement member includes a connection member connecting the rear member to the body member.

According to another aspect, the engagement member defines a joint between the rear member and the body member.

According to a further aspect, the body member also includes an internal support member extending from the crown portion to the sole portion, wherein the engagement member engages the support member.

According to yet another aspect, the head further includes a void extending inwardly from a rear periphery of the body member, such that the rear member is received within the void. The void may be angular in shape, such that the void has a vertex proximate a center of the body member and increases in width from the vertex to the rear periphery. In this configuration, the rear member may be wedge-shaped to complement the shape of the void, and the engagement member may be located proximate the vertex of the void.

According to a further aspect, the engagement member is located along a vertical plane extending through a center of the striking surface, and the rear member is symmetrical with respect to the vertical plane.

According to an additional aspect the engagement member is located along a vertical plane extending through a center of the striking surface, and at least a majority of a mass and at least a majority of a surface area of the rear member are located on a heel side of the vertical plane.

According to other aspects, the engagement member is located along a vertical plane extending through a center of the striking surface, and wherein at least a majority of a mass and at least a majority of a surface area of the rear member are located on a toe side of the vertical plane.

Still further aspects of the disclosure relate to ball striking devices, such as wood-type golf clubs or other golf clubs, with a head that includes a body member that has a face having a striking surface configured for striking a ball and a crown portion and a sole portion connected to the face and extending rearward from the face, where the crown portion, the sole portion, and the face combine to define an internal cavity. The body member has a void extending inwardly from a rear periphery of the body member and extending through the crown portion and the sole portion, and an internal support member is exposed within the void. A rear member is connected to the internal support member of the body member and received within the void, such that the rear member forms portions of a crown and a sole of the head. A connection member connects the rear member to the internal support member of the body member to form a joint between the rear member and the body member, and a resilient member separates the rear member from the body member. The resilient member engages the rear member and the body member within the void and is positioned between a peripheral edge of the body member defining the void and an opposed edge of the rear member, such that the resilient member is configured to transfer momentum between the rear member and the body member.

According to one aspect, the void is angular in shape, such that the void has a vertex proximate a center of the body member and increases in width from the vertex to the rear periphery, wherein the rear member is wedge-shaped to complement the shape of the void. In this configuration, the support member may be located proximate the vertex of the void, and the connection member may be connected to the body member proximate the vertex, such that the joint is positioned proximate the vertex.

According to another aspect, the support member extends from the crown portion to the sole portion, and the rear member is connected to the body member at a crown end of the support member and at a sole end of the support member. The connection member may be or include a pin extending from the crown end to the sole end of the support member, such that the pin connects to the rear member at the crown end and the sole end of the support member. Additionally, the sole end of the support member may be positioned closer to the face than the crown end of the support member, such that the support member angles downward and toward the face from the crown end to the sole end.

According to a further aspect, the connection member and the support member are located along a vertical plane extending through a center of the striking surface, and the rear member is symmetrical with respect to the vertical plane.

According to yet another aspect, the connection member and the support member are located along a vertical plane extending through a center of the striking surface, and at least a majority of a mass and at least a majority of a surface area of the rear member are located on a heel side or a toe side of the vertical plane.

Other aspects of the disclosure relate to ball striking devices, such as wood-type golf clubs or other golf clubs, with a head that includes a body member that has a face having a striking surface configured for striking a ball and a crown portion and a sole portion connected to the face and extending rearward from the face, where the crown portion, the sole portion, and the face combine to define an internal cavity. The body member has a void extending inwardly from a rear periphery of the body member, and the void is V-shaped or U-shaped and is wider at the rear periphery and narrower toward a center of the body member. The body member further has a support member extending from the crown portion to the sole portion, such that the support member is exposed within the void. A rear member is connected to the body member and received within the void, and the rear member has outer surfaces that are contiguous with adjacent outer surfaces of the body member. The rear member is connected to the body member at a crown end of the support member and at a sole end of the support member, such that the rear member forms portions of a crown and a sole of the head. At least one connection member connects the rear member to the support member of the body member in a rigid manner to form a joint between the rear member and the body member, where the at least one connection member connects the rear member to the crown end and the sole end of the support member. A resilient member separates the rear member from the body member, such that the resilient member engages the rear member and the body member within the void and is positioned between a peripheral edge of the body member defining the void and an opposed edge of the rear member. The resilient member is configured to transfer momentum between the rear member and the body member, and wherein the at least one connection member forms a sole area of rigid connection between the rear member and the body member.

Other aspects of the invention relate to a golf club or other ball striking device including a head or other ball striking device as described above and a shaft connected to the head/device and configured for gripping by a user. The shaft may be connected to the body member of the head. Aspects of the invention relate to a set of golf clubs including at least one golf club as described above. Yet additional aspects of the invention relate to a method for manufacturing a ball striking device as described above, including connecting a rear member and/or a resilient material to a body member as described above. Such a method may further include connecting a shaft to the club head.

Other features and advantages of the invention will be apparent from the following description taken in conjunction with the attached drawings.

BRIEF DESCRIPTION OF THE DRAWINGS

To allow for a more full understanding of the present invention, it will now be described by way of example, with reference to the accompanying drawings in which.

DETAILED DESCRIPTION

Figure 2:
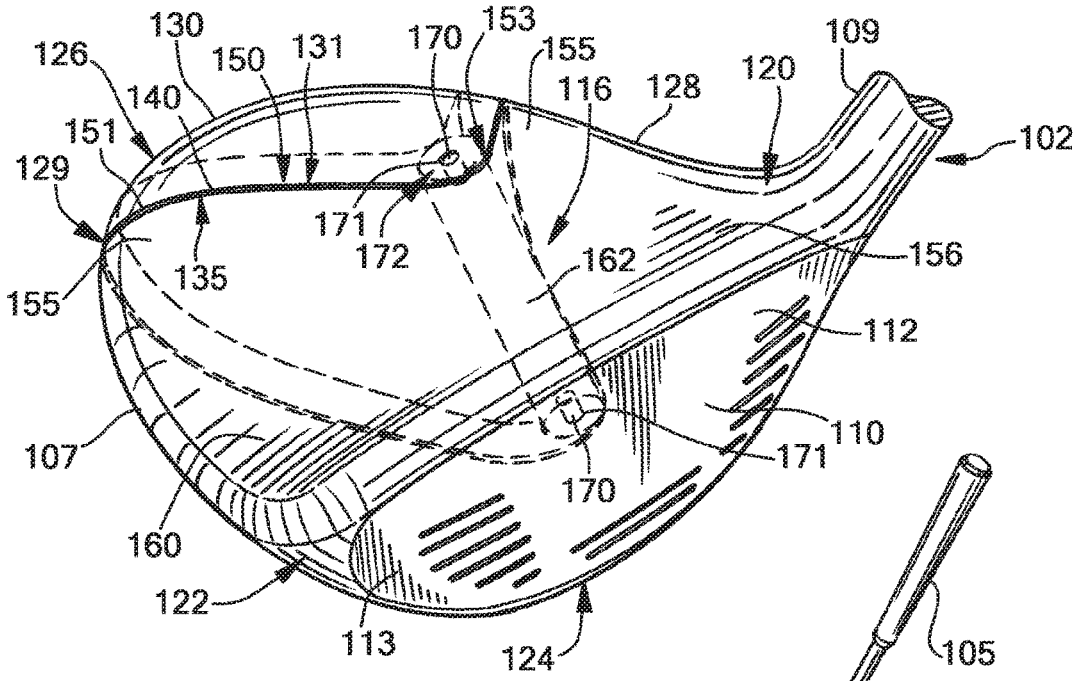
FIG. 2 is a top front perspective view of a head of the ball striking device of FIG. 1.

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," "primary," "secondary," and the like may be used in this specification to describe various example features and elements of the invention, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this invention. Also, the reader is advised that the attached drawings are not necessarily drawn to scale.

The following terms are used in this specification, and unless otherwise noted or clear from the context, these terms have the meanings provided below.

"Ball striking device" means any device constructed and designed to strike a ball or other similar objects (such as a hockey puck). In addition to generically encompassing "ball striking heads," which are described in more detail below, examples of "ball striking devices" include, but are not limited to: golf clubs, putters, croquet mallets, polo mallets, baseball or softball bats, cricket bats, tennis rackets, badminton rackets, field hockey sticks, ice hockey sticks, and the like.

"Ball striking head" means the portion of a "ball striking device" that includes and is located immediately adjacent (optionally surrounding) the portion of the ball striking device designed to contact the ball (or other object) in use. In some examples, such as many golf clubs and putters, the ball striking head may be a separate and independent entity from any shaft or handle member, and it may be attached to the shaft or handle in some manner.

The term "shaft" includes the portion of a ball striking device (if any) that the user holds during a swing of a ball striking device.

"Integral joining technique" means a technique for joining two pieces so that the two pieces effectively become a single, integral piece, including, but not limited to, irreversible joining techniques, such as adhesively joining, cementing, welding, brazing, soldering, or the like. In many bonds made by "integral joining techniques," separation of the joined pieces cannot be accomplished without structural damage thereto.

"Approximately" or "about" means within a range of +/−10% of the nominal value modified by such term.

In general, aspects of this invention relate to ball striking devices, such as golf club heads, golf clubs, and the like. Such ball striking devices, according to at least some examples of the invention, may include a ball striking head and a ball striking surface. In the case of a golf club, the ball striking surface may constitute a substantially flat surface on one face of the ball striking head, although some curvature may be provided (e.g., "bulge" or "roll" characteristics). Some more specific aspects described herein relate to wood-type golf clubs and golf club heads, including drivers, fairway woods, hybrid-type clubs, etc., although aspects described herein may also be utilized in iron-type golf clubs, putters, other types of golf clubs or other ball striking devices, if desired.

According to various aspects of this invention, the ball striking device may be formed of one or more of a variety of materials, such as metals (including metal alloys), ceramics, polymers, composites, fiber-reinforced composites, and wood, and the devices may be formed in one of a variety of configurations, without departing from the scope of the invention. In one embodiment, some or all components of the head, including the face and at least a portion of the body of the head, are made of metal materials. It is understood that the head also may contain components made of several different materials. Additionally, the components may be formed by various forming methods. For example, metal components (such as titanium, aluminum, titanium alloys, aluminum alloys, steels (such as stainless steels), and the like) may be formed by forging, molding, casting, stamping, machining, and/or other known techniques. In another example, composite components, such as carbon fiber-reinforced plastic or other carbon fiber-reinforced polymer composites, can be manufactured by a variety of composite processing techniques, such as injection molding, prepreg processing, powder-based techniques, mold infiltration, and/or other known techniques.

The various figures in this application illustrate examples of ball striking devices and portions thereof according to this invention. When the same reference number appears in more than one drawing, that reference number is used consistently in this specification and the drawings to refer to the same or similar parts throughout.

At least some examples of ball striking devices according to this invention relate to golf club head structures, including heads for wood-type golf clubs. Such devices may include a multiple-piece construction. An example structure of ball striking devices according to this invention will be described in detail below in conjunction with FIGS. 1-25, and will be referred to generally using reference numeral "100."

Figure 1:
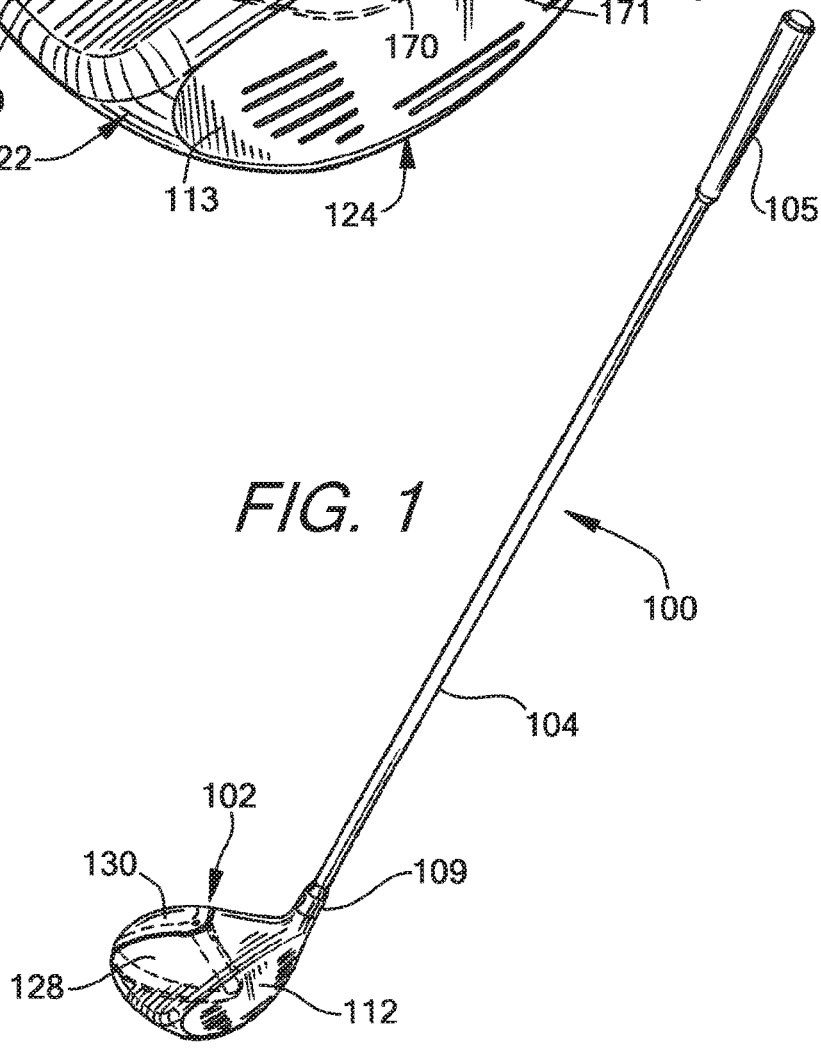
FIG. 1 is a top front perspective view of one embodiment of a ball striking device according to aspects of the present invention, in the form of a golf driver.
Figure 3:
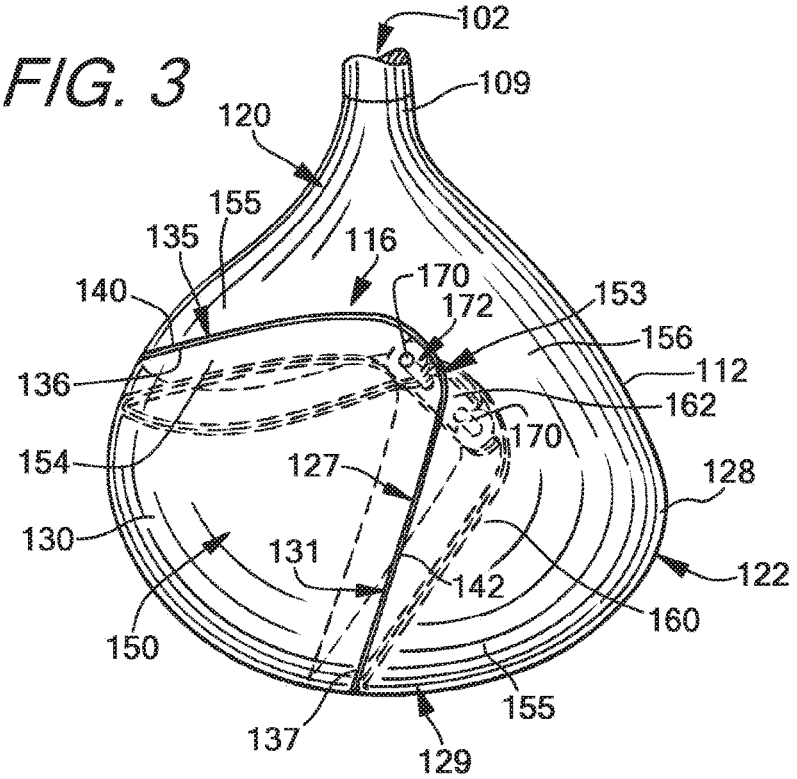
FIG. 3 is a top rear perspective view of the head of FIG. 2.
Figure 4:
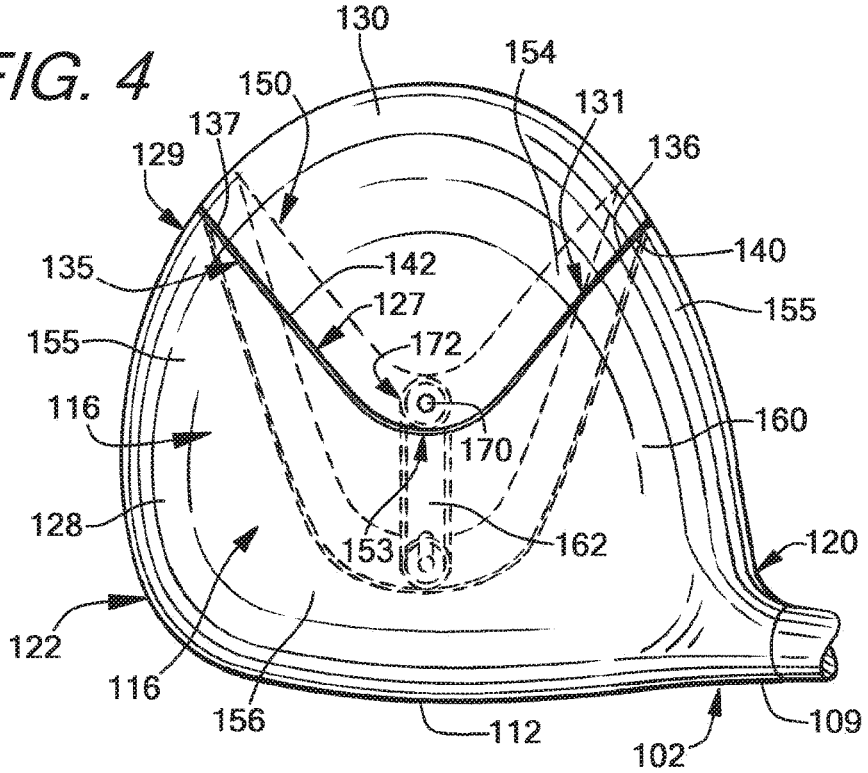
FIG. 4 is a top view of the head of FIG. 2.
Figure 5:
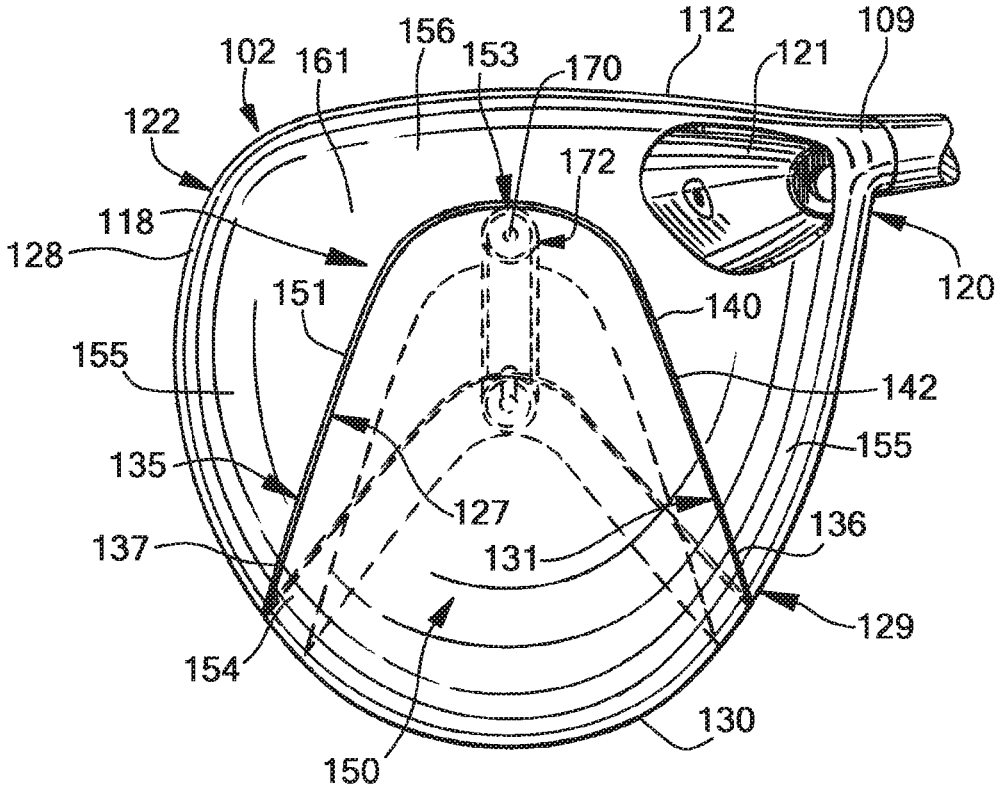
FIG. 5 is a bottom view of the head of FIG. 2.

FIGS. 1-7 illustrate an example of a ball striking device 100 in the form of a golf driver, in accordance with at least some examples of this invention. The ball striking device 100 includes a ball striking head 102 and a shaft 104 connected to the ball striking head 102 and extending therefrom. The ball striking head 102 of the ball striking device 100 of FIGS. 1-7 has a body member 128 that includes a face 112 and a hosel 109 extending therefrom. The body member 128 may include one or more structures connected to the face 112 and located behind the face 112 and/or extending rearwardly from the face 112 that may be referred to as part of a body 107 of the golf club head 102. The ball striking head 102 also has a rear member 130 connected to the body member 128, and a resilient material 140 positioned between the body member 128 and the rear member 130. The body member 128, the rear member 130, and the resilient material 140 may combine to define the golf club head body 107 in some embodiments. The shaft 104 may be connected to the body member 128 at the hosel 109, as shown in FIG. 1, and may include a grip 105 in some embodiments. Any desired hosel and/or head/shaft interconnection structure may be used without departing from this invention, including conventional hosel or other head/shaft interconnection structures as are known and used in the art, or an adjustable, releasable, and/or interchangeable hosel or other head/shaft interconnection structure such as those shown and described in in U.S. Patent Application Publication No. 2009/0062029, filed on Aug. 28, 2007, U.S. Patent Application Publication No. 2013/0184098, filed on Oct. 31, 2012, and U.S. Pat. No. 8,533,060, issued Sep. 10, 2013, all of which are incorporated herein by reference in their entireties and made parts hereof. The head 102 may include an access area 121 on the sole 118 for accessing the hosel structure, as illustrated in FIG. 5.

For reference, the head 102 generally has a golf club head body 107 with a top 116, a bottom or sole 118, a heel 120 (also called a heel side or heel edge) proximate the hosel 109, a toe 122 (also called a toe side or toe edge) distal from the hosel 109, a front side 124, and a back or rear side 126. The body member 128, alone or in combination with the rear member 130, defines an internal cavity 111, which may be empty or at least partially filled with a material, such as foam or another material. In this configuration, the body member 128 has a thin wall construction, typical to many metallic wood-type golf club heads. In other embodiments, the body member 128 may have a solid or predominately solid construction. The shape and design of the head 102 may be partially dictated by the intended use of the device 100. In the club 100 shown in FIGS. 1-7, the head 102 has a face 112 with some degree of incline, as the club 100 is designed for use as a driver or other wood-type club, intended to hit the ball medium to long distances, with some degree of lift and arcing trajectory. In this embodiment, the club head 102 may have a volume of at least 400 cc, and in some structures, at least 450 cc, or even at least 460 cc. It is understood that the head 102 may be configured as a different type of ball striking device in other embodiments, including other types of wood-type golf club heads as mentioned above, or similar devices. In other applications, such as for a different type of golf club head, the head may be designed to have different dimensions and configurations. If, for example, the head 102 is configured as a fairway wood head, the club head may have a volume of at least 120-300 cc, and if configured as a hybrid club head, the club head may have a volume of at least 85-140 cc. Other appropriate sizes for other club heads may be readily determined by those skilled in the art.

The face 112 is located at the front 124 of the body member 128, and has a striking surface or ball striking surface 110 located thereon. The ball striking surface 110 is configured to face a ball in use (not shown), and is adapted to strike the ball when the device 100 is set in motion, such as by swinging. As shown, the ball striking surface 110 occupies most of the face 112. The face 112 may include some curvature in the top to bottom and/or heel to toe directions (e.g., bulge and roll characteristics), and may also include functional face grooves, as is known and is conventional in the art. In other embodiments, the surface 110 may occupy a different proportion of the face 112, or the body member 128 may have multiple ball striking surfaces 110 thereon. In the embodiment shown in FIGS. 1-7, the ball striking surface 110 has an incline or loft angle, to launch the ball on a trajectory. Additionally, the face 112 may have one or more internal or external inserts in some embodiments.

It is understood that the body member 128 and/or the hosel 109 can be formed as a single piece or as separate pieces that are joined together. In one embodiment, the body member 128 of a head 102 as shown in FIGS. 1-7, as well as the embodiments shown in FIGS. 8-25, may be made from multiple pieces, such as a face member (e.g., a face plate, a cup-face, a face insert, etc.) that forms at least the face 112 and one or more additional pieces that form at least portions of the crown 116, the sole 118, and other portions of the body 107. Such multiple pieces may be joined using an integral joining technique, such as welding, cementing, or adhesively joining, or other known techniques, including many mechanical joining techniques, such as releasable mechanical engagement techniques. For example, the face 112 in the embodiment of FIGS. 1-7 is at least partially formed by a face insert 113 that is connected to the front of the body member 128, as illustrated in FIG. 7. This face insert 113 may be received in a recess 115 at the front 124 of the head 102. In other embodiments, the body member 128 (including the entire face 112) may be formed of a single piece, or a different type of face member may be used, such as an edge-welded face plate, a cup-face structure, etc. Further, the hosel 109 may be formed as a separate piece, which may be joined using these or other techniques, or may be integrally formed with the body member 128. As illustrated in FIG. 5, the access area 121 for the hosel 109 may include walls 123 that extend from the sole 118 to the crown 116 and tie the crown 116 and the sole 118 together, in one embodiment.

The body member 128 in the embodiment of FIGS. 1-7 has a crown portion 160 and a sole portion 161 that extend rearwardly from the face 112 and form at least portions of the crown 116 and sole 118 respectively. In the embodiment of FIGS. 1-7, the rear member 130 also forms portions of the crown 116 and the sole 118 of the club head 102, however in other embodiments, the rear member 130 may not form any portion of the crown 116 and/or the sole 118.

Figure 19:
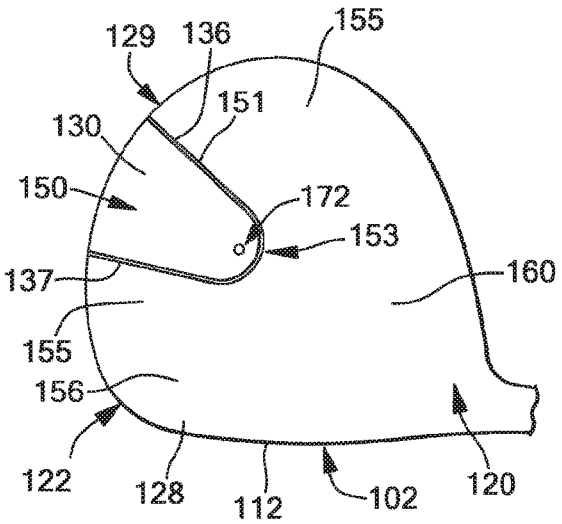
FIG. 19 is a top view of another embodiment of a ball striking device according to aspects of the present invention.
Figure 20:
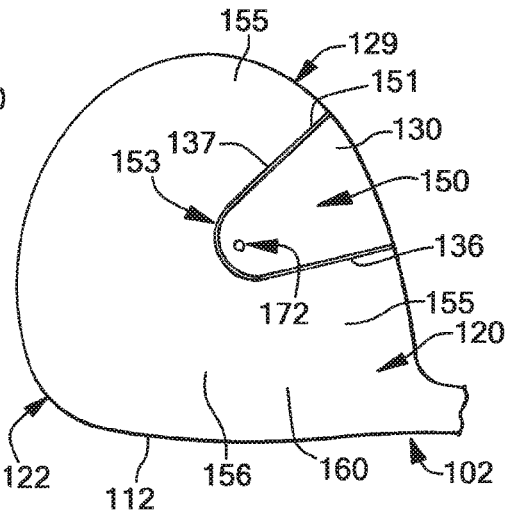
FIG. 20 is a top view of another embodiment of a ball striking device according to aspects of the present invention.

In the embodiment shown in FIGS. 1-7, the rear side 127 of the body member 128 has a receiver in the form of a void 150 configured for at least partially receiving the rear member 130 in one embodiment. The void 150 extends inwardly from the rear periphery 129 of the body member 128 in the embodiment of FIGS. 1-7, and the void 150 is generally symmetrical about a vertical plane that extends through the geometric center of the striking face 110 in this embodiment. The void 150 may extend inwardly from the rear periphery 129 of the body member 128 while being offset from such a vertical plane in other embodiments, such as the embodiments in FIGS. 19-20. In the embodiment of FIG. 19, the void 150 occupies a portion of the rear periphery 129 that is completely on the toe side of the vertical plane, and in this configuration, at least a majority of the mass, the surface area, and/or the volume of the rear member 130 is located on the toe side of the vertical plane. In the embodiment of FIG. 20, the void 150 occupies a portion of the rear periphery 129 that is completely on the heel side of the vertical plane, and at least a majority of the mass, the surface area, and/or the volume of the rear member 130 is located on the heel side of the vertical plane.

Figure 6:
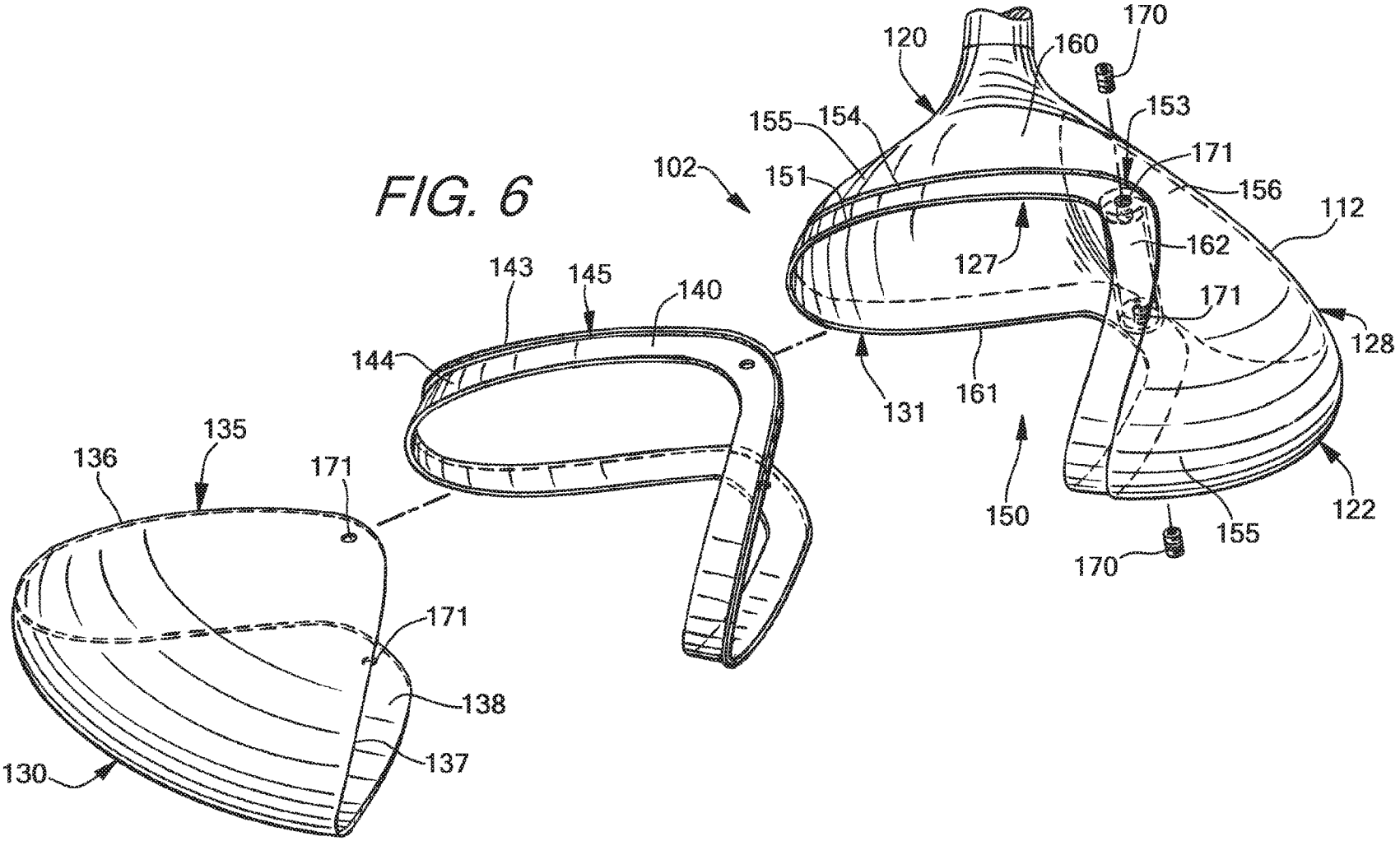
FIG. 6 is an exploded rear perspective view of the head of FIG. 2.
Figure 7:
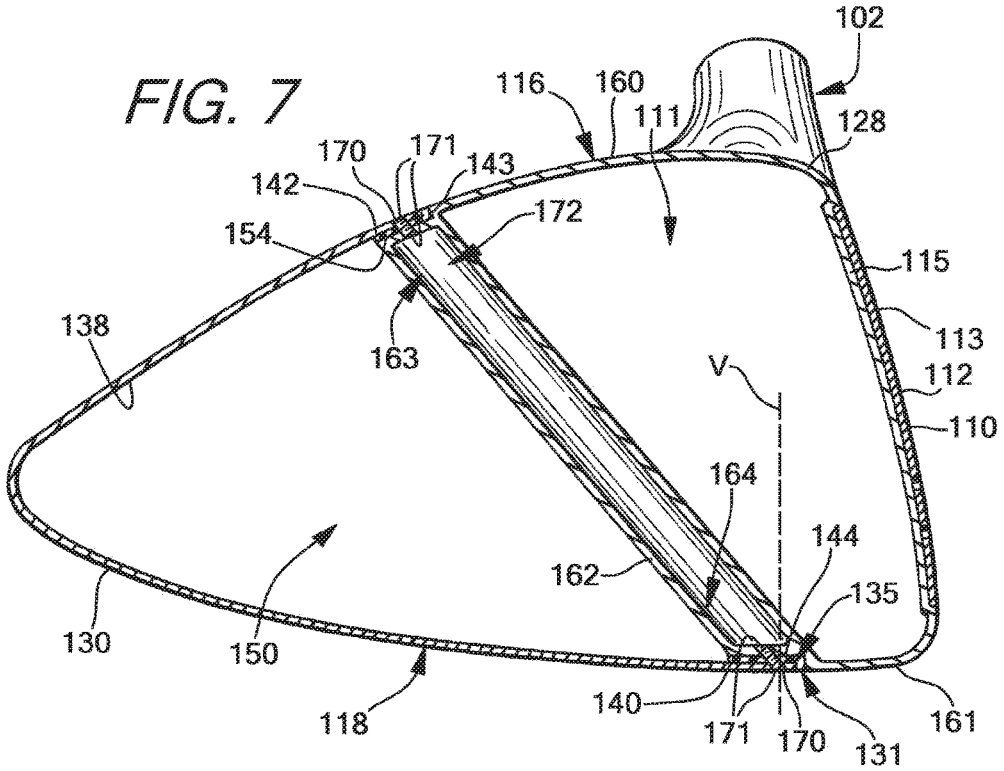
FIG. 7 is a cross-sectional view of the head of FIG. 2, taken along a vertical plane extending through the geometric center of the face.
Figure 18:
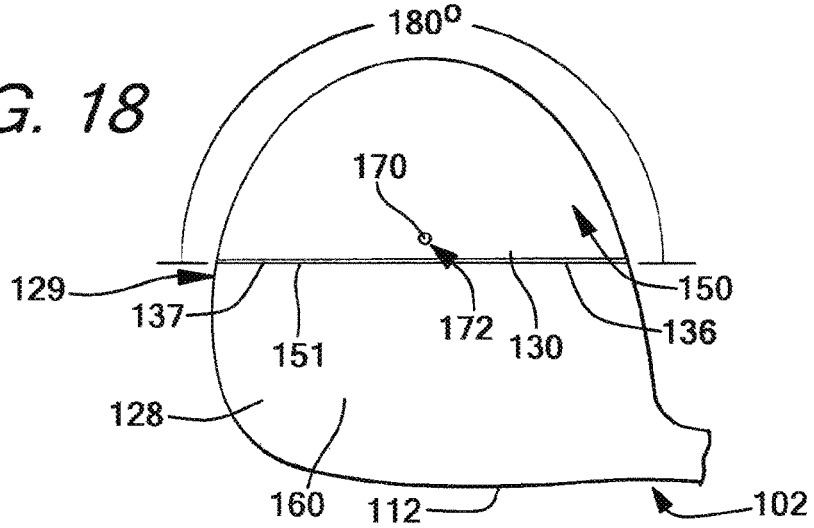
FIG. 18 is a top view of another embodiment of a ball striking device according to aspects of the present invention.
Figure 22:
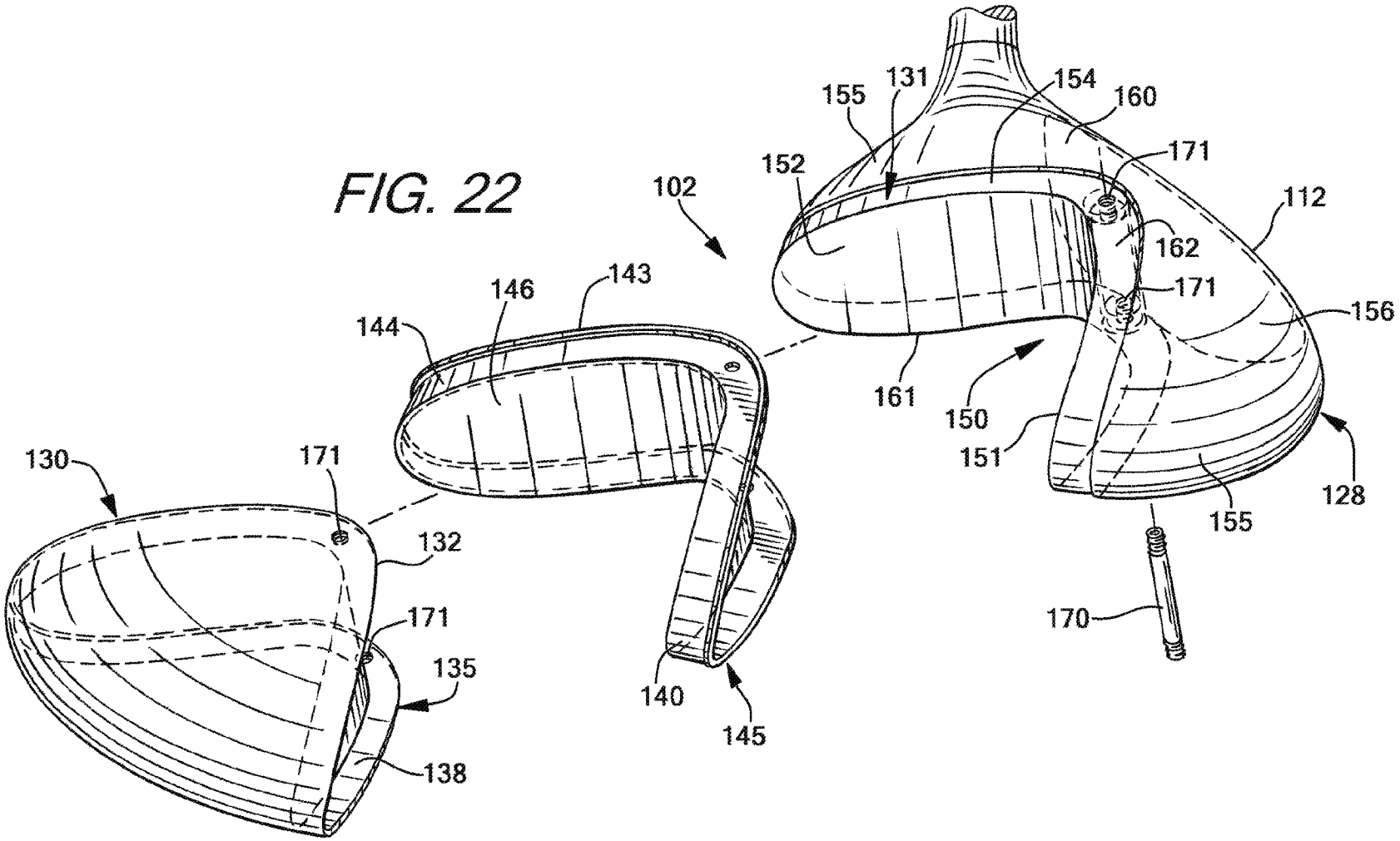
FIG. 22 is an exploded rear perspective view of another embodiment of a ball striking device according to aspects of the present invention.
Figure 23:
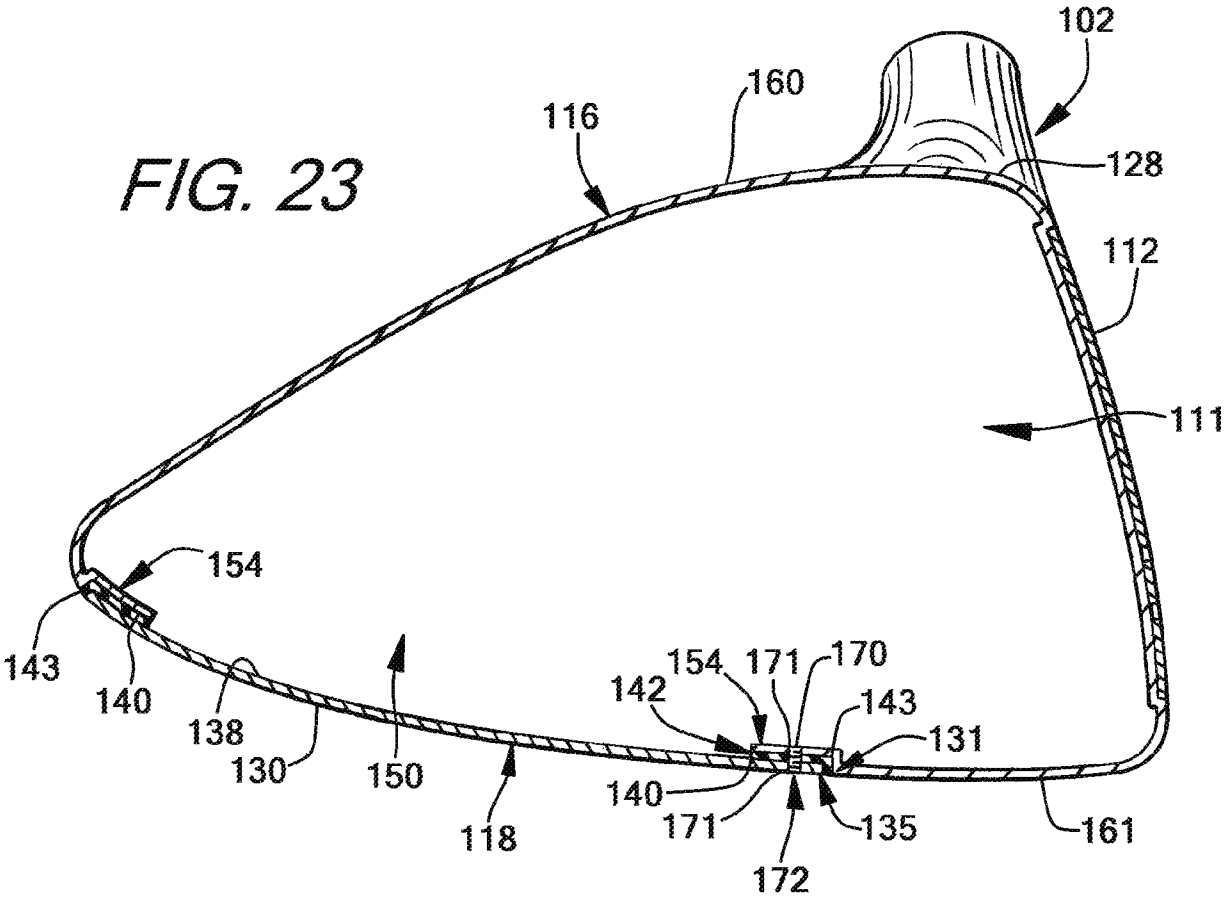
FIG. 23 is a cross-sectional view of another embodiment of a ball striking device according to aspects of the present invention, taken along a vertical plane extending through the geometric center of the face.
Figure 24:
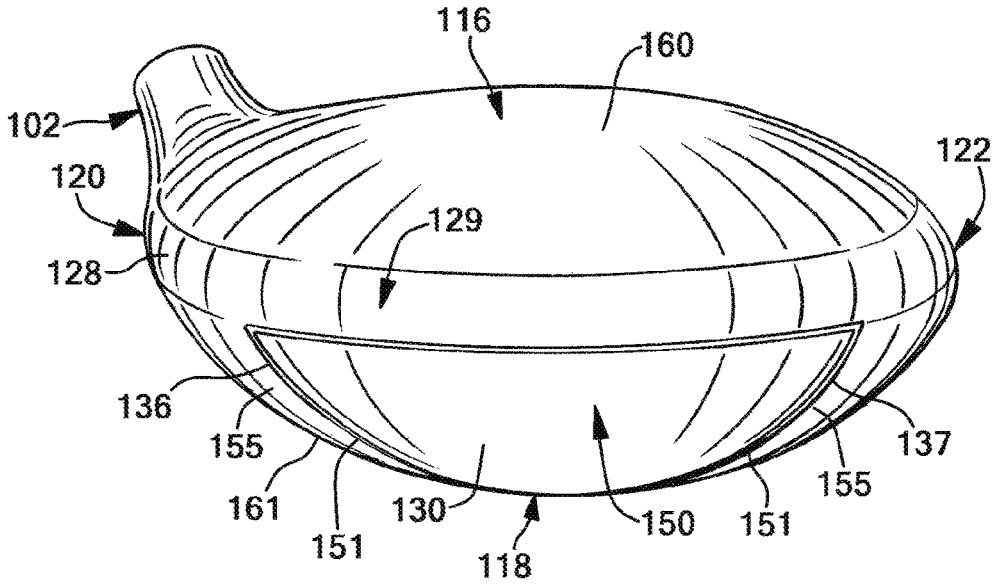
FIG. 24 is a rear view of one embodiment of the club head of FIG. 23.
Figure 25:
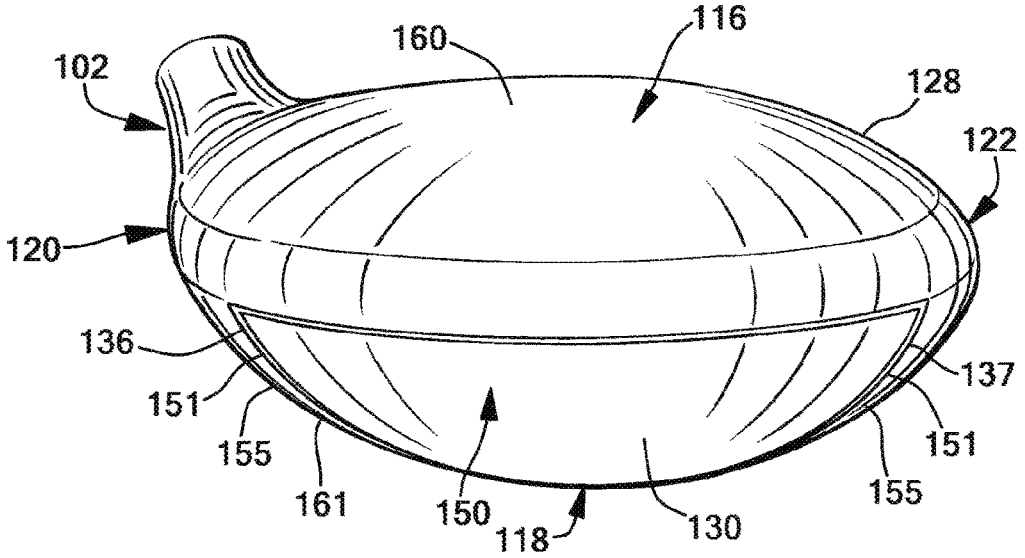
FIG. 25 is a rear view of another embodiment of the club head of FIG. 23.

The body member 128 as shown in FIGS. 1-7 has two legs 155 defining the void 150, such that the void 150 is located between the legs 155. The legs 155 in this embodiment extend rearwardly from a main body portion 156 of the body member 128 to form a portion of the rear periphery 129 of the body member 128. In one embodiment, as shown in FIG. 6, portions of the body member 128 around the void 150 (e.g., the legs 155) may be open, such that the interior cavity 111 of the body member 128 is at least partially open within the void 150. In this embodiment, the void 150 is defined by one or more edges 151 on the legs 155. In another embodiment, as shown in FIG. 22, the portions of the body member 128 around the void 150 may be closed, such that the interior cavity 111 is completely enclosed by the body member 128. In this embodiment, the void 150 is further defined by side walls 152 on the legs 155 that extend between the edges 151. It is understood that the body member 128 could also be solid, with no interior cavity, or that the interior cavity 111 may be further divided into multiple cavities or chambers. Additionally, the void 150 extends through both the crown portion 160 and the sole portion 161 of the body member 128 in the embodiment of FIGS. 1-7. In another embodiment, the void 150 may be formed in only the crown portion 160 or the sole portion 161, such that the void 150 has a top wall or a bottom wall. For example, FIGS. 23-25 illustrate an embodiment where the void 150 is formed only in the sole portion 161, as described in greater detail elsewhere herein. In yet another embodiment, as illustrated in FIG. 18, the body member 128 may not have separate legs 155 that define the sides of the void 150, as the entire rear surface 131 of the body member 128 is flat. Further, in one embodiment, as shown in FIGS. 1-7, the void 150 has a recessed area 154 extending around at least a portion of the edges 151 defining the void 150, which is configured to receive portions of the rear member 130 and/or the resilient member 140, as described in greater detail herein.

The void 150 is angularly shaped in the embodiment of FIGS. 1-7, meaning that the void 150 has a width that is narrower proximate a center of the body 107 and increases in width toward the rear periphery. In some embodiments, the void 150 may have an identifiable vertex 153 at its narrowest point. For example, in the embodiment of FIGS. 1-7, the vertex 153 is proximate the center of the body 107. The void 150 may have different angular dimensions in various embodiments. For example, FIGS. 13-18 illustrate body members 128 with voids 150 having angular shapes approximately equal to 30°, 45°, 60°, 90° and 180°, respectively. It is understood that the embodiment of FIGS. 1-7, or any other embodiment described herein, may have a void 150 with any of these angular shapes or another angular shape. It is also understood that the edges 151 defining the void 150 may define one angular shape on the crown portion 160 and another angular shape on the sole portion 161 in one embodiment. It is further understood that a void 150 may be considered to have an "angular" shape as defined herein for any angle up to (but not including) 180°. The void 150 in the embodiment of FIGS. 1-7 may also be described as being V-shaped or U-shaped. In further embodiments, the void 150 may not have an angular shape, i.e., as shown in FIG. 18.

The ball striking device 100 may include a shaft 104 connected to or otherwise engaged with the ball striking head 102, as shown in FIG. 1. The shaft 104 is adapted to be gripped by a user to swing the ball striking device 100 to strike the ball. The shaft 104 can be formed as a separate piece connected to the head 102, such as by connecting to the hosel 109, as described above. In other embodiments, at least a portion of the shaft 104 may be an integral piece with the head 102, and/or the head 102 may not contain a hosel 109 or may contain an internal hosel structure. Still further embodiments are contemplated without departing from the scope of the invention. The shaft 104 may be constructed from one or more of a variety of materials, including metals, ceramics, polymers, composites, or wood. In some exemplary embodiments, the shaft 104, or at least portions thereof, may be constructed of a metal, such as steel, or a composite, such as a carbon/graphite fiber-polymer composite. However, it is contemplated that the shaft 104 may be constructed of different materials without departing from the scope of the invention, including conventional materials that are known and used in the art.

In general, the head 102 of the ball striking device 100 has a rear member 130 connected to the body member 128 at the rear side 127 of the body member 128. In one embodiment, the body member 128 and the rear member 130 have one or more confronting surfaces that have at least some lateral component, i.e., at least some component that extends along a direction generally parallel to the face 112. For example, in the embodiment of FIGS. 1-7, the rear member 130 has front surfaces 135 that face and confront the rear surfaces 131 of the body member 128. The front surfaces 135 of the rear member 130 and the rear surfaces 131 of the body member are tapered outwardly (toward the heel 120 and toe 122) and rearwardly, as described above, and the outward taper of these surfaces 135, 131 creates this lateral component. In general, the rear member 130 is configured to transfer energy and/or momentum to the body member 128 upon impact of the ball on the striking surface 110, including an off-center impact. The lateral component of the confronting surfaces 135, 131 of the rear member 130 and the body member 128 facilitate this transfer of energy and/or momentum. Additionally, in one embodiment, the body member 128 and the rear member 130 follow generally the same outer periphery, to form a generally contiguous outer periphery of the head 102, as illustrated in FIGS. 2-5 and 7, however in other embodiments, at least a portion of these members 128, 130 may have a different outer periphery.

The rear member 130 may be connected to the body member 128 in a number of different configurations that permit energy and/or momentum transfer between the rear member 130 and the body member 128, several of which are described below and shown in the FIGS. In other embodiments, the rear member 130 may be differently configured, and/or the head 102 may contain multiple rear members 130. For example, the rear member 130 as shown in FIGS. 1-7 may be divided into two, three, or more separate rear members 130 in another embodiment, which may be connected to the body member 128 in similar or different configurations.

Figure 12:
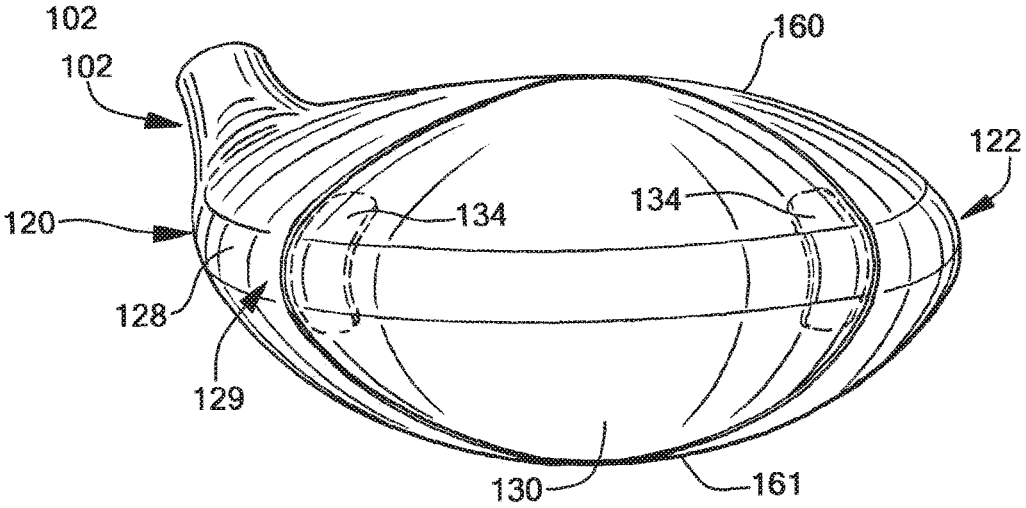
FIG. 12 is a rear view of another embodiment of a ball striking device according to aspects of the present invention.
Figure 13:
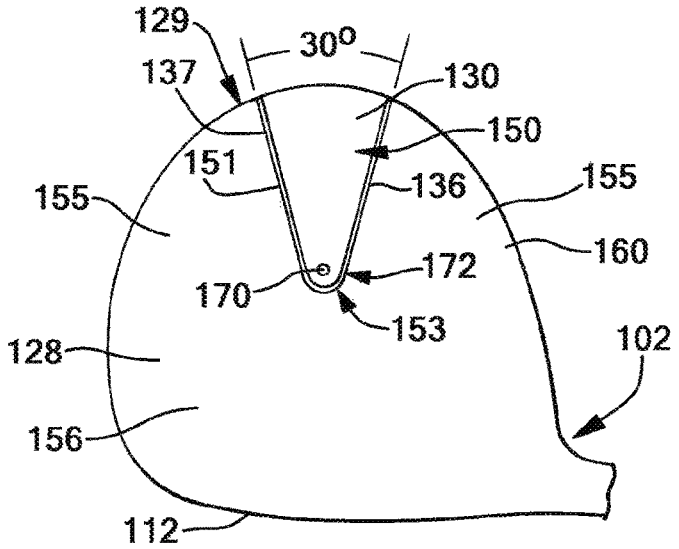
FIG. 13 is a top view of another embodiment of a ball striking device according to aspects of the present invention.
Figure 14:
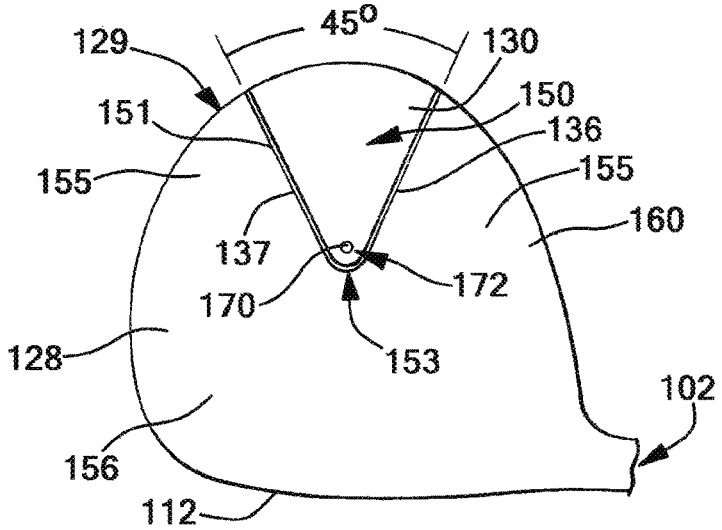
FIG. 14 is a top view of another embodiment of a ball striking device according to aspects of the present invention.
Figure 15:
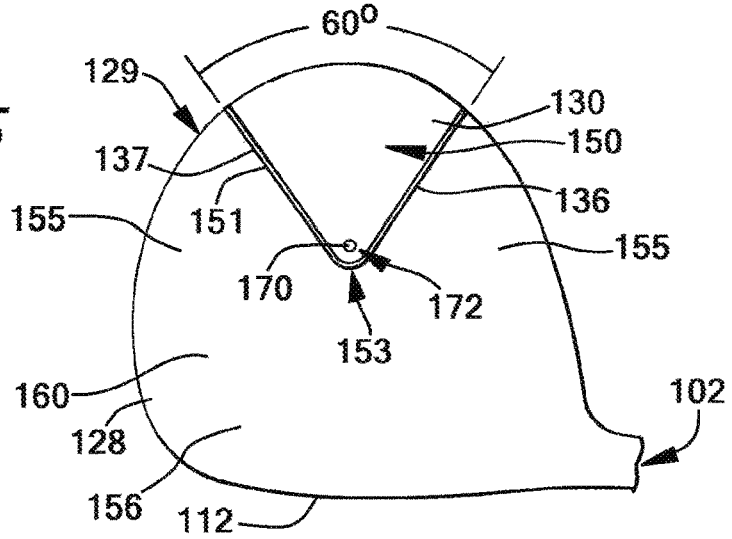
FIG. 15 is a top view of another embodiment of a ball striking device according to aspects of the present invention.
Figure 16:
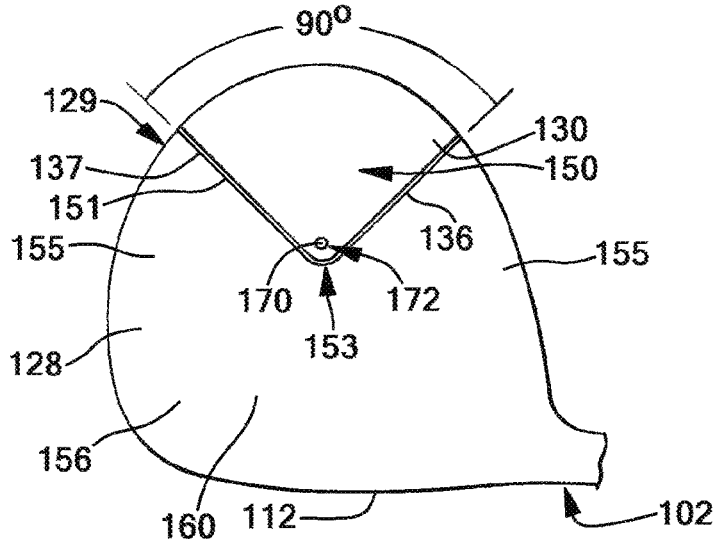
FIG. 16 is a top view of another embodiment of a ball striking device according to aspects of the present invention.
Figure 17:
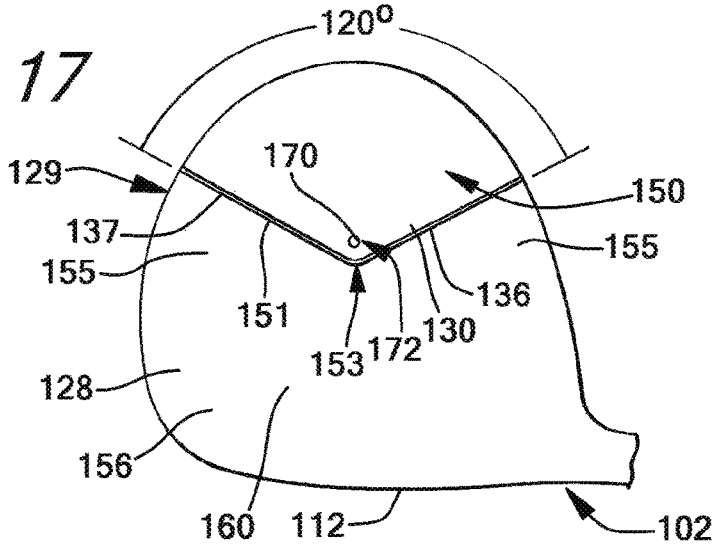
FIG. 17 is a top view of another embodiment of a ball striking device according to aspects of the present invention.

The rear member 130 in all embodiments may affect or influence the center of gravity of the head 102, and in one embodiment, the rear member 130 may be more heavily weighted than the body member 128, overall and/or in specific locations. The rear member 130 may be made of any of a variety of different materials, which may be selected based on their weight or density. For example, the rear member 130 may be made from a metallic material such as stainless steel and/or tungsten, or may be made from other materials, for example polymers that may be doped with a heavier material (e.g. tungsten). The rear member 130 may also include portions that may be more heavily weighted than others, and may include weighted inserts or other inserts. FIG. 12 illustrates one embodiment where the rear member 130 has weights 134 positioned proximate the heel-most area and the toe-most area of the rear member 130. These weights 134 may be separate weights attached to an inner surface of the rear member 130, or may be cavities that are filled with a weighting material, such as a polymer material doped with tungsten or other heavy material, in various embodiments. The weights 134 may further be removable and/or interchangeable in one embodiment, such as by being removably received in weight ports located on the rear member 130. Additionally, the rear member 130 may be more heavily weighted than the body member 128 by having thicker walls over the entire rear member 130 or in localized areas in one embodiment, which permits the rear member 130 to be more heavily weighted than the body member 128 while being made from the same or similar material. In other embodiments, the rear member 130 may have the same density as the body member 128, or even a smaller density. Further, the rear member 130 may be partially or completely solid in one embodiment, such as the embodiment shown in FIG. 22.

In the embodiment of FIGS. 1-7, the rear member 130 is separated from the body member 128 by a resilient member 145 at least partially formed of the resilient material 140. In this embodiment, the rear member 130 may be considered to be at least partially suspended with respect to the body member 128 by the resilient material 140. It is understood that an adhesive or other bonding material may be utilized to connect the resilient material 140 to the body member 128 and/or the rear member 130, and that other connection techniques may be used in other embodiments, such as mechanical fasteners, interlocking designs (e.g. dovetail, tab and slot, etc.) and others. The resilient material 140 may be connected to the body member 128, the rear member 130, or both, in various embodiments. The resilient material 140 may be an epoxy-based material, a natural or synthetic rubber material, a polyurethane-based elastomer, or other elastomeric material in one embodiment, but may be a different type of resilient material in another embodiment, including various types of resilient polymers, such as foam materials or other rubber-like materials. Additionally, the resilient material 140 may have at least some degree of resiliency, such that the resilient material 140 exerts a response force when compressed, and can return to its previous state following compression. The resilient material 140 may have a strength or flexibility that is lower than, and may be significantly lower than, the strength/flexibility of the material of the body member 128 and/or the rear member 130. In one embodiment, the resilient material 140 may have a hardness of from 30-90 Shore A or approximately 30-90 Shore A. In another embodiment, the resilient material 140 may have a hardness of approximately 60-70 Shore A. The hardness may be determined, for example, by using ASTM D-2240 or another applicable test with a Shore durometer. In an example embodiment, the resilient material 140 may be an epoxy-based material with a hardness of approximately 40-80 Shore D, or approximately 70-80 Shore D. In another example embodiment, the resilient material 140 may be a polyurethane-based elastomer with a hardness of approximately 65 Shore A. Further, in one embodiment, the resilient material may have compression properties (based on a 0.56 shape factor and determined using ASTM D-575) as follows: 30 psi for 5% deflection, 70 psi for 10% deflection, 110 psi for 15% deflection, 160 psi for 20% deflection, and 220 psi for 25% deflection. Still further, the resilient material 140 may be any material described in U.S. Patent Application Publication No. 2013/0137533, filed Nov. 30, 2011, which application is incorporated by reference herein in its entirety and made part hereof.

The properties of the resilient material, such as hardness and/or resiliency, may be designed for use in a specific configuration. For example, the hardness and/or resiliency of the resilient material 140 may be designed to ensure that an appropriate rebound or reaction force is transferred to the face, which may be influenced by parameters such as material thickness, mass and/or shapes of various components (including the rear member 130 and/or the body member 128), intended use of the head 102 (e.g., expected swing speed of the user), and others. The hardness and resiliency may be achieved through techniques such as material selection and any of a variety of treatments performed on the material that can affect the hardness or resiliency of the resilient material, as discussed elsewhere herein. The flexibility and thickness of the resilient material may be tuned to the weight of a particular rear member 130. For example, heavier weights may require less flexible resilient material 140, and lighter weights may require more flexible resilient material 140. Using a thinner resilient material 140 may also necessitate the use of a more flexible material, and a thicker resilient material 140 may be usable with less flexible materials. In a configuration where the resilient material 140 is an epoxy-based material, the resilient material 140 may have a thickness between the rear member 130 and the rear surface 131 of the body member 128 of approximately 0.5-3.0 mm in one embodiment.

In the embodiment shown in FIGS. 1-7, the resilient member 145 may be formed as a single, integral piece of the resilient material 140; however the resilient member 145 may be formed of separate pieces in various embodiments. The resilient member 145 and/or the resilient material 140 may be formed of multiple components as well, including components having different hardness in different regions, including different hardness distributions. For example, the resilient member 145 and/or the resilient material 140 may be formed of an exterior shell that has a different (higher or lower) hardness than the interior, such as through being made of a different material (e.g. through co-molding) and/or being treated using a technique to achieve a different hardness. Examples of techniques for achieving a shell with a different hardness include plasma or corona treatment, adhesively bonding a film to the exterior, coating the exterior (such as by spraying or dipping). If a cast or other polyurethane-based material is used, the resilient material 140 may have a thermoplastic polyurethane (TPU) film bonded to the exterior, a higher or lower hardness polyurethane coating applied by spraying or dipping, or another polymer coating (e.g. a thermoset polymer), which may be applied, for example, by dipping the resilient material into an appropriate polymer solution with an appropriate solvent. Additionally, the resilient member 145 and/or the resilient material 140 may have different hardness or compressibility in different lateral or vertical portions thereof, which can create different energy and/or momentum transfer effects in different locations. For example, the resilient member 145 and/or the resilient material 140 may have a higher or lower hardness in proximate the heel 120 and/or the toe 122, which may be achieved by techniques described herein, such as treatments or use of different materials and/or separate pieces. In this configuration, the hardness of the resilient material 140 may be customized for use by a particular golfer or a particular golfer's hitting pattern. Similarly, an asymmetrical resilient member 145 may also be used to create different energy and/or momentum transfer effects, by providing a larger or smaller amount of material at specific portions of the body member 128. Such an asymmetrical resilient member 145 may also be used to provide customizability. A variable-hardness or asymmetrical resilient member 145 may also be used in conjunction with an offset connection point, as discussed below, for further customizability. Other embodiments described herein may also employ a resilient material 140 that has a variable hardness or asymmetrical features. A single-component or multi-component resilient member 145 and/or resilient material 140 may be manufactured by co-molding, and may be co-molded in connection with the body member 128 and/or the rear member 130.

As seen in FIGS. 1-7, the resilient material 140 is connected between the rear member 130 and the body member 128. In the embodiment of FIGS. 1-7, the resilient member 145 has a first portion 143 that extends outwardly and engages the front surface 135 of the rear member 130 and the rear surface 131 of the body member 128, and the resilient material 140 also has a second portion 144 positioned between the inner surfaces 138 of the rear member 130 and the recessed portion 154 of the body member 128 around the void 150. The rear member 130 is spaced from the body member 128, and the resilient material 140 at least partially fills the spaces 142 between the rear member 130 and the body member 128 around the void 150. In the embodiment illustrated in FIGS. 1-7, portions of the rear member 130 sit within the recessed area 154 around the void 150, such that the outer surfaces of the body member 128 and the rear member 130 are substantially flush with each other and form a generally contiguous surface. Additionally, the resilient material 140 in this embodiment also sits within the recessed area 154 and is substantially flush with the outer surfaces of the body member 128 and the rear member 130 around the entire periphery of the head 102. In other embodiments, the body member 128, the rear member 130, and/or the resilient material 140 (or portions of such members) may not be flush or substantially flush around at least a portion of the periphery of the head 102. In an embodiment such as in FIG. 22, where the body member 128 has walls 152 within the void 150 and/or the rear member 130 has a solid outer configuration, the resilient member 145 may further include webbing portions 146 that line the additional surfaces within the void 150 (e.g., the walls 152) to space these additional surfaces from each other.

The resilient material 140 may be positioned on both opposite lateral sides of the center of gravity (CG) of the body member 128. In one embodiment, as shown in FIG. 7, the resilient material 140 completely or substantially completely fills the spaces 142 between the rear member 130 and the body member 128 around the periphery of the void 150. In another embodiment, may have a resilient material 140 that partially fills the spaces 142 between the body member 128 and the rear member 130, such as the resilient material 140 being positioned between the body member 128 and the rear member 130 at least proximate the heel 120 and the toe 122. In the embodiment of FIG. 22, the resilient material 140 completely fills all spaces between the rear member 130 and the body member 128.

The rear member 130 may have various different dimensions and structural properties in various embodiments. In the embodiment shown in FIGS. 1-7, the rear member 130 has a lateral width defined between the heel and toe edges 136, 137. The rear member 130 in the embodiment illustrated in FIGS. 1-7 is wedge-shaped, i.e., having an angular shape to complement and correspond to the shape of the angular void 150. In other words, the lateral width of the rear member 130 tapers, such that the rear member 130 is narrower proximate the center of the body 107 and proximate the vertex 153 of the void 150, and becomes wider proximate the rear 126 of the head 102. The lateral width of the rear member 130 is less than the lateral width of the body member 128, measured between the heel 120 and toe 122, in the embodiment of FIGS. 1-7. For a wedge-shaped rear member 130, the difference in lateral width between the body member 128 and the rear member 130 may be at least partially dependent on the angle defined by the void 150 and/or the rear member 130. In another embodiment, as shown in FIG. 18, the rear member 130 may have a lateral width that is similar to that of the body member 128. Additionally, the rear member 130 may have its mass distributed proportionally more toward the heel and toe edges 136, 137, such as by using structures described herein for this purpose. Further, the rear member 130 may be positioned so that the CG of the rear member 130 is substantially aligned with the CG of the body member 128. In one embodiment, the CGs of the rear member 130 and the body member 128 are laterally aligned and not vertically aligned. In another embodiment, these respective CGs may additionally or alternately be vertically aligned.

Figure 21:
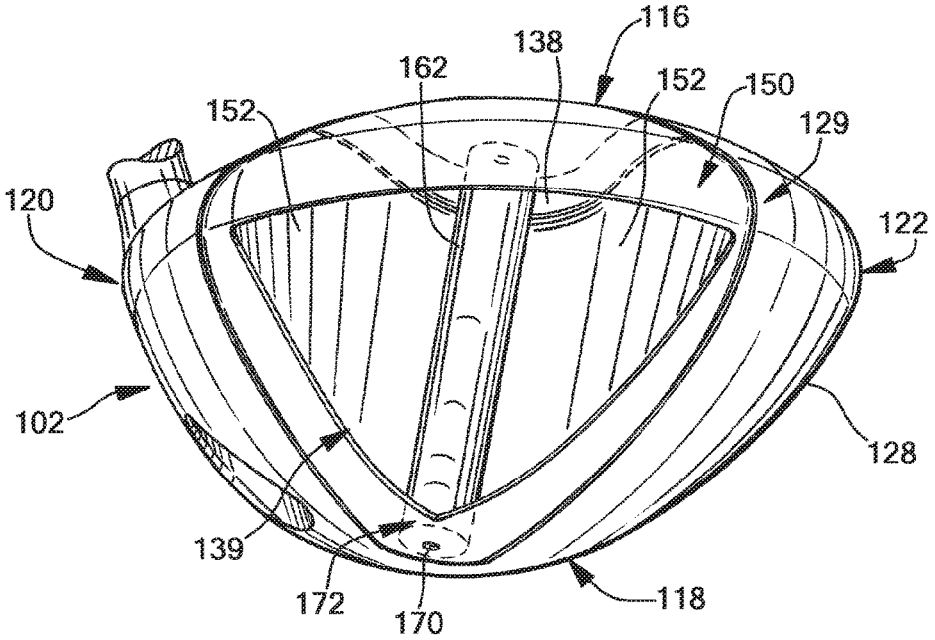
FIG. 21 is a bottom rear perspective view of another embodiment of a ball striking device according to aspects of the present invention.

The rear member 130 is a hollow shell member with a thin-wall construction in one embodiment, such as illustrated in FIGS. 1-7. Additionally, the rear member 130 in this embodiment is open around the front surfaces 135, so that the interior surfaces 138 of the rear member 130 are exposed. The heel edge 136 and toe edge 137 of the rear member 130 are relatively C-shaped in the configuration illustrated in FIGS. 1-7. In other embodiments, the rear member 130 may have a solid or partially solid structure and/or a different shape. For example, in the embodiment of FIG. 22, the rear member 130 has a solid outer structure with a lip 132 that extends from the front surfaces 135 to sit within the recessed area 154 of the body member 128. As another example, the rear member 130 in FIGS. 23-25 has a cup-shaped configuration. The rear member 130 in FIG. 22 may have a hollow, enclosed structure that defines a second internal cavity (not shown) therein, or may have a completely solid structure. In a further embodiment, as illustrated in FIG. 21, the rear member 130 may have an open bottom 139, such that the inner surface 138 of the rear member 130 is exposed on the underside of the crown 116. The rear member 130 in the embodiment of FIG. 21 is configured similarly to the rear member 130 of FIGS. 1-7, with an opening cut into the bottom side to form the open bottom 139. In another embodiment, the rear member 130 may have no bottom portion, and may include a top shell with an open bottom 139, with the rear member 130 forming a portion of the crown 116 and little to no portion of the sole 118. The body member 128 in the embodiment of FIG. 21 includes walls 152 defining the void 150 and separating the void 150 from the interior cavity 111, similar to the embodiment of FIG. 22. It is understood that a rear member 130 with an open bottom 139, such as in FIG. 21 may also be used with body members 128 that have an open or partially open rear, such as in FIGS. 1-7. Still further configurations for the rear member 130 are possible in additional embodiments.

The rear member 130 may have varying sizes in different embodiments. For example, in one embodiment, the rear member 130 may make up about 25% or more of the total weight of the head 102, or 25-50% of the total weight of the head 102. In an example embodiment, the total weight of the head 102 may be about 200 g (including any connection method), with the rear member 130 having a weight of about 50 g. In additional example embodiment, the total weight of the head 102 may be about 195-215 g, or may be about 190-250 g, with the rear member 130 making up 35-50% of the weight of the head 102, which may be utilized in one of the configurations illustrated in FIGS. 1-6 and 12-22.

Figure 8:
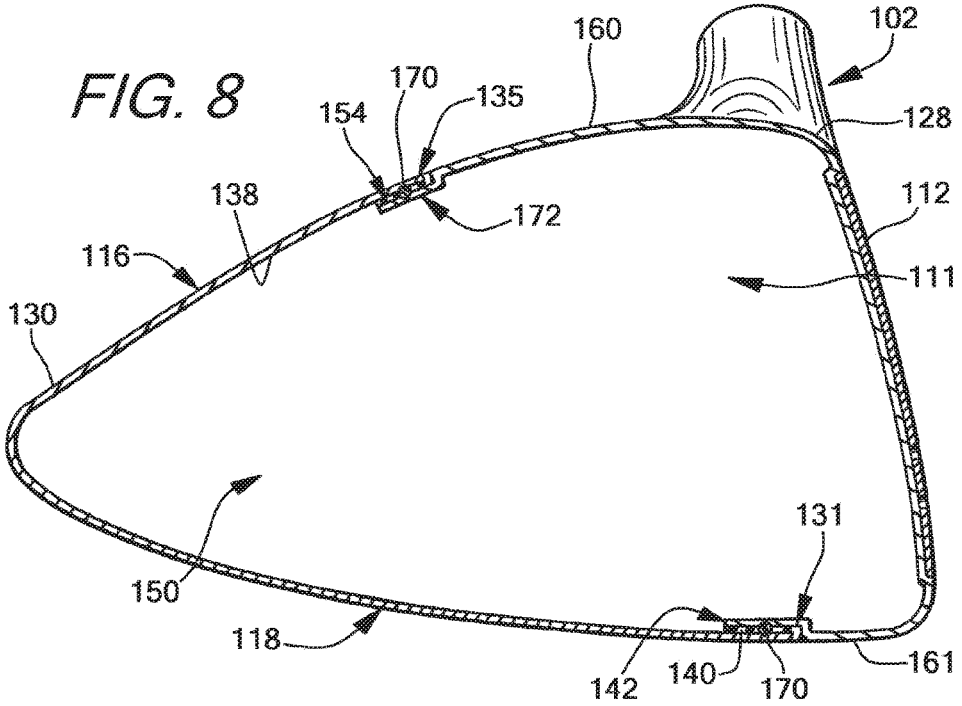
FIG. 8 is a cross-sectional view of another embodiment of a ball striking device according to aspects of the present invention, taken along a vertical plane extending through the geometric center of the face.
Figure 9:
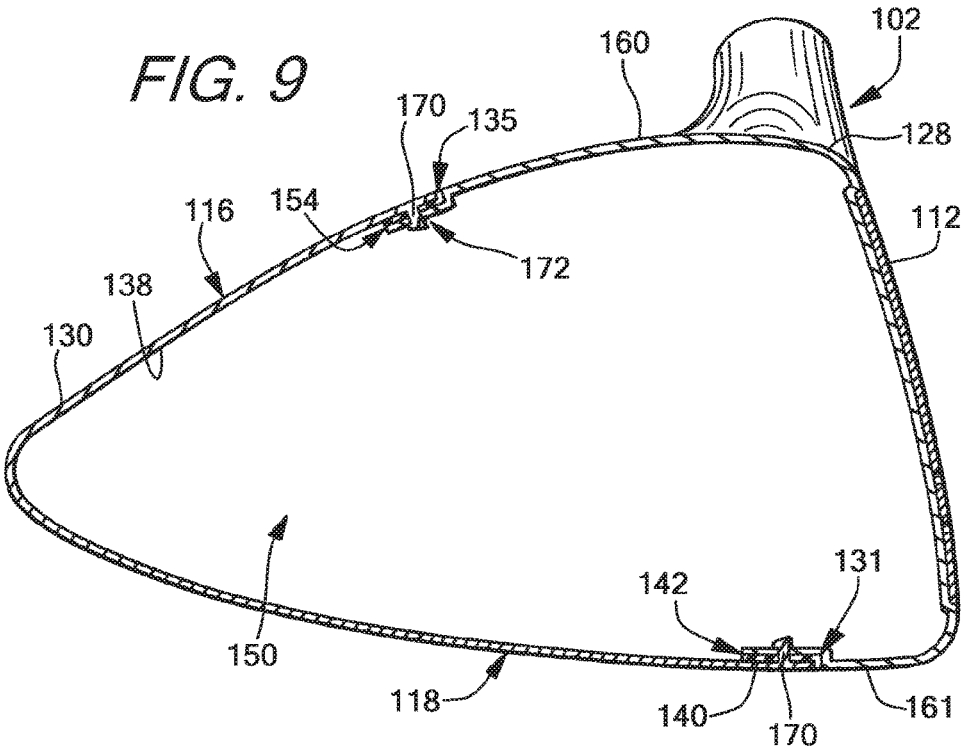
FIG. 9 is a cross-sectional view of another embodiment of a ball striking device according to aspects of the present invention, taken along a vertical plane extending through the geometric center of the face.

In certain example embodiments, the body member 128 and the rear member 130 may be connected together by one or more connection members. In the embodiment of FIGS. 1-7, the head 102 includes connection members 170 in the form of screws, pins, or other such members. As seen in FIGS. 6 and 7, the connection members 170 extend through openings 171 in both the rear member 130 and the body member 128 on the crown 116 and the sole 118. The connection points of these connection members 170 are proximate the vertex 153 of the void 150, and create a joint 172 between the rear member 130 and the body member 130 located at the connection points of the connection members 170. Thus, in one embodiment, the joint 172 is located proximate the vertex 153 of the void 150. In other embodiments, different types of connection members 170 may be used, such as other fasteners, clips, tabs, complementary interlocking structures, etc. For example, in one embodiment, as shown in FIG. 22, the head 102 may have a single connection member 170 in the form of an elongated pin that extends through openings 171 in both the crown 116 and the sole 118 to connect the rear member 130 to the body member 128, forming a joint 172, as described above. It is understood that fasteners may be used to connect to one or both ends of the connection members 170 of FIGS. 1-7 and 22. In another embodiment, as illustrated in FIG. 8, the connection member(s) 170 may be in the form of ball joints. In a further embodiment, as illustrated in FIG. 9, the connection member(s) 170 may be configured as resilient tabs or other structures fixedly connected to the body member 128 or the rear member 130 and extending through openings 171 in the other of the body member 128 and the rear member 130. In FIG. 9, the connection members 170 are illustrated as tabs that are formed on the inner surface of the rear member 130 and extend through openings 171 in the body member 128. It is understood that the resilient material 140 may include gaps, openings, cutouts, etc., to permit the connection member(s) 170 to engage the rear member 130 and the body member 128 on opposite sides of the resilient material 140.

Additionally, in one embodiment, the connection member(s) 170 (and the resultant joint 172) may connect the body member 128 and the rear member 130 in an arrangement such that the connection member(s) 170 are the only point(s) of direct and/or rigid engagement between the body member 128 and the rear member 130. In this configuration, the connection member(s) 170 and/or the joint 172 forming the point(s) of rigid engagement may be laterally aligned with the CG of the club head. It is understood that "rigid" engagement as defined herein does not necessary imply any fixing or attachment, but instead, means that the surfaces engaging each other are rigid, rather than flexible, and behave rigidly during energy and/or momentum transfer. As described herein, the other portions of the body member 128 and rear member 130 may be separated from each other by the resilient material 140. In another embodiment, the connection member(s) 170 may be removable and reconnectable, to permit removal and interchanging of rear members 130 and/or body members 128. The resilient tabs in the embodiment of FIG. 9 may function as removable connection members 170, as well as other structures. In a further embodiment (not shown), the body member 128 and the rear member 130 may be connected by bonding to the resilient material 140, and no connection member(s) 170 may be used. The rear member 130 in this configuration may be considered to be completely suspended by the resilient material 140, with no points of rigid connection between the body member 128 and the rear member 130.

In certain example embodiments, the body member 128 may have a support member 162 that extends from the crown portion 160 to the sole portion 161 and through the internal cavity 111. The support member 162 may provide structural support to the body member 128, particularly at the connection point(s) of the connection member(s) 170, and may also influence the CG of the head 102. In the embodiment of FIGS. 1-7, the support member 162 is a hollow tube member that extends from the crown portion 160 to the sole portion 161 and is positioned at least partially within the internal cavity 111 and/or exposed to the internal cavity 111. The support member 162 in this embodiment is also positioned at least partially within the void 150 and/or exposed to the void 150. As seen in FIGS. 6-7, the internal cavity 111 may be contiguous with the void 150. In another embodiment, as shown in FIG. 22, the body member 128 may have side walls 152 that close off the internal cavity 111. In this embodiment, the support member 162 is connected to the two side walls 152, and is therefore exposed to both the void 150 and the internal cavity 111. However, in other embodiments, the support member 162 may be completely inside or outside the closed internal cavity 111. In additional embodiments, other configurations of support members 162 may be used. For example, in FIG. 10, the support member 162 is in the form of a solid rod or post that extends from the crown portion 160 to the sole portion 161. The solid support member 162 may further increase structural strength, and may also carry increased weight. In another embodiment, the head 102 may include walls that function as a support member 162, which may be similar to the side walls 152 shown in FIG. 22. In further embodiments, the body member 128 may include other types of support members 162, including multiple support members, or the body member 128 may have no support member 162, such as in the embodiments of FIGS. 8-9.

Figure 10:
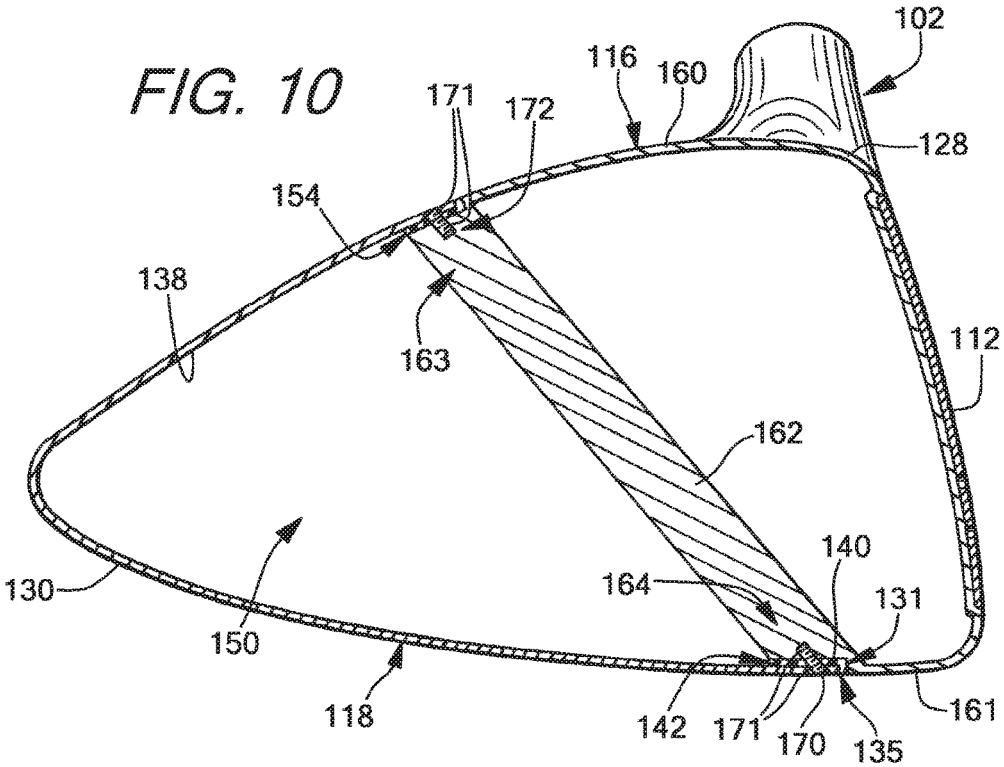
FIG. 10 is a cross-sectional view of another embodiment of a ball striking device according to aspects of the present invention, taken along a vertical plane extending through the geometric center of the face.

The support member 162 may generally support the areas where the rear member 130 is connected to the body member 128 in some embodiments. In the embodiment of FIGS. 1-7, the rear member 130 may be connected to the body member 128 at one or both ends of the support 162 and/or connected directly to the support member 162. The support member 162 as shown in FIGS. 6-7 includes a crown end 163 connected to the crown portion 160 of the body member 128 and a sole end 164 connected to the sole portion 161 of the body member 128. The connection members 170 in this embodiment are connected to the crown portion 160 and the sole portion 161 directly at the ends 163, 164 of the support 162. In this configuration, the support 162 is aligned with the joint 172 and may be considered to define the joint 172. This configuration can provide greater structural integrity to the portions of the body member 128 to which the rear member 130 is connected. In another embodiment, as shown in FIG. 10, the connection member(s) 170 may be connected directly to the support 162, such that the opening(s) 171 receiving the connection member(s) 170 extend into the body of the support 162. The support 162 (if present) and the connection member(s) 170 may be differently configured in other embodiments.

Figure 11:
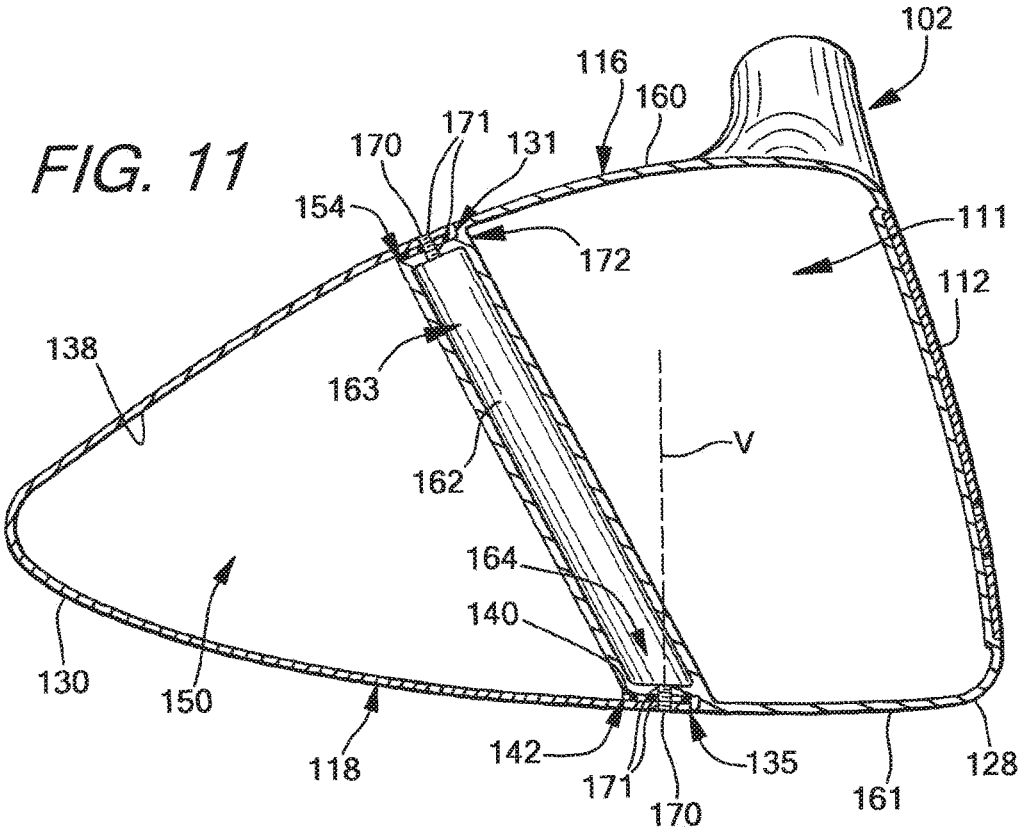
FIG. 11 is a cross-sectional view of another embodiment of a ball striking device according to aspects of the present invention, taken along a vertical plane extending through the geometric center of the face.

The support member 162 may be obliquely angled with respect to the vertical axis (i.e., an axis perpendicular to a flat playing surface when the head 102 is in the lie position) and/or with respect to the general plane of the striking surface 110, in one embodiment. As shown most clearly in FIG. 7, the support member 162 in the embodiment of FIGS. 1-7 has a central axis of elongation oriented at an oblique angle to both the vertical axis V and to the plane of the striking surface 110. FIG. 11 illustrates an alternate embodiment, where the axis of the support member 162 is closer to vertical and has a smaller angle with respect to the vertical axis. In this embodiment, the axis of the support member 162 is nearly parallel to the plane of the striking surface 110. The axis of the support member may, in various embodiments, be oriented at angles of approximately 15°, 30°, 45°, or 60° with the vertical axis, or at angles of approximately 10°, 20°, 30°, or 45° with the plane of the striking surface 110. In a further embodiment, the support member 162 may be parallel to the plane of the striking surface 110 or aligned with the vertical axis. In other embodiments, the support member 162 may have a different orientation, or the head 102 may have multiple support members with multiple orientations, or no support members at all.

FIGS. 23-25 illustrate an embodiment where the body member 128 defines a void 150 only on the sole portion 161, which does not extend into the crown portion 160, with a rear member 130 positioned in the void 150. In other words, the void 150 extends from the sole 118 and no farther than the outermost periphery of the head 102, so that the crown 116 completely covers the void 150 and the rear member 130 when the club head 102 is viewed from above (i.e., in the address position). The void 150 illustrated in FIGS. 23-25 is angular in shape, as described herein, and is in communication with the internal cavity 111 of the club head 102. In another embodiment, the void 150 may have a top wall that partially or completely separates the void 150 from the internal cavity 111. The angle of the void 150 may be any angle as described herein with respect to the void 150 of FIGS. 1-7. FIGS. 24 and 25 illustrate two different potential angular configurations of the void 150 and the rear member 130.

The rear member 130 in FIGS. 23-25 generally has a cup or bowl shape in this embodiment, and is formed as a shell member in one embodiment, as seen in FIG. 23. In another embodiment, the rear member 130 may be partially or completely solid and/or may have a hollow, enclosed structure, e.g., as in FIG. 22. The rear member 130 may further include any weighting configurations as described herein.

The body member 128 and the rear member 130 in FIGS. 23-25 are connected by a connection member 170 in the form of a pin that extends through an opening 171 in the sole 118 to connect the rear member 130 to the body member 128, forming a joint 172, as described above. Additionally, the void 150 has a recessed area 154 extending around part or all of its periphery in this embodiment, as similarly described herein with respect to FIGS. 1-7. In this embodiment, portions of the rear member 130 sit within the recessed area 154 around the void 150, such that the outer surfaces of the body member 128 and the rear member 130 are substantially flush with each other and form a generally contiguous surface. Additionally, the resilient material 140 in this embodiment also sits within the recessed area 154 and is substantially flush with the outer surfaces of the body member 128 and the rear member 130 around the entire periphery of the head 102. In one embodiment, the resilient material 140 extends around the entire peripheries of the void 150 and the rear member 130 to separate the rear member 130 from the body member 128. The connection member 170 in this embodiment forms the sole area of rigid engagement between the body member 128 and the rear member 130.

In further embodiments, a club head 102 may have a void 150 and a rear member 130 on the sole 118, in a shape, configuration, or orientation that is different from FIGS.

23-25. For example, the club head 102 may have a "flat" rear surface 131, such that the void 150 and the rear member 130 have a 180° configuration, similar to the configuration illustrated in FIG. 25. Any other features described above with respect to the embodiments of FIGS. 1-22 may be utilized in connection with the head 102 of FIGS. 23-25.

The rear member 130 may be configured such that energy and/or momentum can be transferred between the rear member 130 and the body member 128 during impact, including an off-center impact on the striking surface 110. The resilient material 140 can serve to transfer energy and/or momentum between the rear member 130 and the body member 128 during impact. Additionally, the rear member 130 may also be configured to resist deflection of the body member 128 upon impact of the ball on the striking surface 110. The resiliency and compression of the resilient material 140 permits this transfer of energy and/or momentum from the rear member 130 to the body member 128. As described above, the momentum of the rear member 130 compresses the resilient material 140 and causes the resilient material 140 exert a response force on the body member 128 to achieve this transfer of momentum. The resilient material 140 may exert at least a portion of the response force on the body member 128 through expansion after the compression. The rear member 130 may deflect slightly toward the impact point to compress the resilient material 140 in the process of this momentum transfer. The actions achieving the transfer of momentum occur between the beginning and the end of the impact, which in one embodiment of a golf driver may be between 400-600 microseconds.

In the embodiments shown in FIGS. 1-25, the rear member 130 may transfer a greater or smaller amount of energy and/or momentum depending on the location of the impact on the striking surface 110. For example, in this embodiment, upon an off-center impact of the ball centered on the heel side 120, face 110 tends to deflect rearwardly at the heel 120, which causes the body member 128 to deflect in the same manner. As another example, upon an off-center impact of the ball centered on the toe side 122, the face 112 tends to deflect rearwardly at the toe 122, which causes the body member 128 to deflect in the same manner. As the body member 128 begins to deflect rearwardly, at least some of the forward momentum of the rear member 130 is transferred to the body member 128 during impact to resist this deflection. In the embodiment of FIGS. 1-7, on a heel-side impact, at least some of the momentum transferred to the body member 128 and to the face 112 may be transferred from the heel edge 136 of the rear member 130 to the body member 128 during impact. Likewise, on a toe-side impact, at least some of the momentum transferred to the body member 128 and to the face 112 may be transferred from the toe edge 137 of the rear member 130 to the body member 128 during impact. Generally, at least some of this momentum is transferred toward the impact point on the face 112. In one embodiment, energy and/or momentum transfer may occur on impacts across the entire or substantially the entire width of the face 112.

The resilient material 140 can function to transfer the energy and/or momentum of the rear member 130 to the body member 128 at the heel 120 or toe 122. In the process of transferring energy and/or momentum during impact, the resilient material 140 may be compressed by the momentum of the rear member 130 and expand to exert a response force on the body member 128, which resists deflection of the body member 128 as described above. It is understood that the degree of potential moment causing deflection of the body member 128 may increase as the impact location diverges from the center of gravity of the body member 128. In one embodiment, the energy and/or momentum transfer from the rear member 130 to the body member 128 may also increase as the impact location diverges from the center of gravity of the body member 128, to provide increased resistance to such deflection of the body member 128. In other words, the energy and/or momentum transferred from the rear member 130 to the body member 128, and the force exerted on the body member 128 by the rear member 130, through the resilient material 140, may be incremental and directly relative/proportional to the distance the impact is made from the optimal impact point (e.g. the lateral center point of the striking surface 110 and/or the CG of the body member 128, in exemplary embodiments). Thus, the head 102 will transfer the energy and/or momentum of the rear member 130 incrementally in the direction in which the ball makes contact away from the center of gravity of the head 102, via the rear member 130 suspended by the resilient material 140. The transfer of energy and/or momentum between the rear member 130 and the body member 128 can reduce the degree of twisting of the face 112 and keep the face 112 more square upon impacts, including off-center impacts. Additionally, the transfer of energy and/or momentum between the rear member 130 and the body member 128 can minimize energy loss on off-center impacts, resulting in more consistent ball distance on impacts anywhere on the face 112. The resilient material 140 may have some elasticity that assists in transferring energy and/or momentum between the rear member 130 and the body member 128.

It is understood that any of the embodiments of ball striking devices 100, heads 102, body members 128, rear members 130, and other components described herein may include any of the features described herein with respect to other embodiments described herein, including structural features, functional features, and/or properties, unless otherwise noted. It is understood that the specific sizes, shapes, orientations, and locations of various components of the ball striking devices 100 and heads 102 described herein are simply examples, and that any of these features or properties may be altered in other embodiments. In particular, any of the connecting members or structures shown and described herein may be used in connection with any embodiment shown herein, to connect the body member 128 and the rear member 130.

Heads 102 incorporating the features disclosed herein may be used as a ball striking device or a part thereof. For example, a golf club 100 as shown in FIG. 1 may be manufactured by attaching a shaft or handle 104 to a head that is provided, such as the head 102 as described above. As another example, a golf club 100 as shown in FIG. 1 may be manufactured by attaching a rear member 130 to a body member that is provided, such as the body member 128 as described above. "Providing" the head, as used herein, refers broadly to making an article available or accessible for future actions to be performed on the article, and does not connote that the party providing the article has manufactured, produced, or supplied the article or that the party providing the article has ownership or control of the article. In other embodiments, different types of ball striking devices can be manufactured according to the principles described herein. In one embodiment, a set of golf clubs can be manufactured, where at least one of the clubs has a head according to one or more embodiments described herein. Such a set may include at least one wood-type club, at least one iron-type club, and/or at least one putter. For example, a set may include one or more wood-type golf clubs and one or more iron-type golf clubs, which may have different loft angles, where at least one wood-type club has a head 102 as described above and shown in FIGS. 1-25. The various clubs in the set may have rear members 130 that may be slightly different in shape, size, location, orientation, etc., based on the loft angle of the club. The various clubs may also have an added weight amount or weight distribution (including CG location) that may be different based on characteristics such as the type and loft angle of the club.

Different rear members 130 and different locations, orientations, and connections thereof, may produce different energy and/or momentum transfer upon impacts on the striking surface 110, including off-center impacts. Additionally, different rear members 130 and different locations, orientations, and connections thereof, may produce different effects depending on the location of the ball impact on the face 112. Accordingly, one or more clubs can be customized for a particular user by providing a club with a head as described above, with a rear member 130 that is configured in at least one of its shape, size, location, orientation, etc., based on a hitting characteristic of the user, such as a typical hitting pattern or swing speed. Customization may also include adding or adjusting weighting according to the characteristics of the rear member 130 and the hitting characteristic(s) of the user, and/or removing and interchanging the rear member 130 with another rear member 130. Still further embodiments and variations are possible, including further techniques for customization.

The ball striking devices described herein may be used by a user to strike a ball or other object, such as by swinging or otherwise moving the head 102 to strike the ball on the striking surface 110 of the face 112. During the striking action, the face 112 impacts the ball, and one or more rear members 130 may transfer energy and/or momentum to the face 112 during the impact, in any manner described above. In one embodiment, the rear member(s) 130 may transfer incrementally greater energy and/or momentum for impacts that are farther from the desired impact point (e.g. the CG). As described below, the devices described herein, when used in this or a comparable method, may assist the user in achieving more consistent accuracy and distance of ball travel, as compared to other ball striking devices.

The various embodiments of ball striking heads with rear members described herein can provide energy and/or momentum transfer upon impacts on the striking face, which can assist in keeping the striking face more square with the ball, particularly on off-center impacts, which can in turn provide more accurate ball direction. Additionally, the energy and/or momentum transfer to the body member can reduce or minimize energy loss on off-center impacts, creating more consistent ball speed and distance. The energy and/or momentum transfer may be incremental based on the distance of the impact away from the desired or optimal impact point. Further, the resilient material may achieve some energy absorption or damping on center impacts (e.g. aligned with the center point and/or the CG of the face). As a result of the reduced energy loss on off-center hits, reduced twisting of the face on off-center hits, and/or reduced energy transfer on center hits that can be achieved by the heads as described above, greater consistency in both lateral dispersion and distance dispersion can be achieved as compared to typical ball striking heads of the same type, with impacts at various locations on the face. The ball striking heads described herein can also provide dissipation of impact energy through the resilient material, which can reduce vibration of the club head and may improve feel for the user. Still further benefits can be recognized and appreciated by those skilled in the art.

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

What is claimed is:

1. A wood-type golf club head comprising:

a body member comprising a face having a striking surface configured for striking a ball, and a crown portion and a sole portion connected to the face and extending rearward from the face;

a resilient member engaged with a rear portion of the body member;

a rear member connected to the rear portion of the body member and engaged with the resilient member, such that the resilient member separates the rear member from the body member; and an engagement member engaging the rear member and the body member to form a sole area of rigid engagement between the rear member and the body member, wherein the resilient member is configured to transfer momentum between the rear member and the body member, and wherein the body member further comprises an internal support member extending from the crown portion to the sole portion, wherein the engagement member engages the support member.

2. The wood-type golf club head of claim 1, wherein the engagement member comprises a connection member connecting the rear member to the body member.

3. The wood-type golf club head of claim 1, wherein the engagement member defines a joint between the rear member and the body member.

4. The wood-type golf club head of claim 1, further comprising a void extending inwardly from a rear periphery of the body member, wherein the rear member is received within the void.

5. The wood-type golf club head of claim 4, wherein the void is angular in shape, such that the void has a vertex proximate a center of the body member and increases in width from the vertex to the rear periphery, wherein the rear member is wedge-shaped to complement the shape of the void, and wherein the engagement member is located proximate the vertex of the void.

6. The wood-type golf club head of claim 5, wherein the void defines an angle of approximately 30°.

7. The wood-type golf club head of claim 5, wherein the void defines an angle of approximately 45°.

8. The wood-type golf club head of claim 5, wherein the void defines an angle of approximately 60°.

9. A wood-type golf club head comprising:

a body member comprising a face having a striking surface configured for striking a ball, and a crown portion and a sole portion connected to the face and extending rearward from the face, wherein the crown portion, the sole portion, and the face combine to define an internal cavity, wherein the body member has a void extending inwardly from a rear periphery of the body member and extending through the crown portion and the sole portion, wherein the body member further comprises an internal support member exposed within the void;

a rear member connected to the internal support member of the body member and received within the void, wherein the rear member forms portions of a crown and a sole of the head;

a connection member connecting the rear member to the internal support member of the body member to form a joint between the rear member and the body member; and a resilient member separating the rear member from the body member, wherein the resilient member engages the rear member and the body member within the void and is positioned between a peripheral edge of the body member defining the void and an opposed edge of the rear member, wherein the resilient member is configured to transfer momentum between the rear member and the body member.

10. The wood-type golf club head of claim 9, wherein the void is angular in shape, such that the void has a vertex proximate a center of the body member and increases in width from the vertex to the rear periphery, wherein the rear member is wedge-shaped to complement the shape of the void.

11. The wood-type golf club head of claim 10, wherein the support member is located proximate the vertex of the void, and wherein the connection member is connected to the body member proximate the vertex, such that the joint is positioned proximate the vertex.

12. The wood-type golf club head of claim 9, wherein the support member extends from the crown portion to the sole portion, and wherein the rear member is connected to the body member at a crown end of the support member and at a sole end of the support member.

13. The wood-type golf club head of claim 12, wherein the connection member comprises a pin extending from the crown end to the sole end of the support member, wherein the pin connects to the rear member at the crown end and the sole end of the support member.

14. The wood-type golf club head of claim 12, wherein the sole end of the support member is positioned closer to the face than the crown end of the support member, such that the support member angles downward and toward the face from the crown end to the sole end.

15. The wood-type golf club head of claim 12, further comprising a second connection member, wherein the connection member connects the rear member to the body member at a crown end of the support member and the second connection member connects the rear member to the body member at a sole end of the support member.

16. The wood-type golf club head of claim 9, wherein the connection member and the support member are located along a vertical plane extending through a center of the striking surface, and wherein the rear member is symmetrical with respect to the vertical plane.

17. The wood-type golf club head of claim 9, wherein the connection member and the support member are located along a vertical plane extending through a center of the striking surface, and wherein at least a majority of a mass and at least a majority of a surface area of the rear member are located on a heel side or a toe side of the vertical plane.

18. A wood-type golf club head comprising:

a body member comprising a face having a striking surface configured for striking a ball, and a crown portion and a sole portion connected to the face and extending rearward from the face, wherein the crown portion, the sole portion, and the face combine to define an internal cavity, wherein the body member has a void extending inwardly from a rear periphery of the body member, wherein the void is V-shaped and is wider at the rear periphery and narrower toward a center of the body member, the body member further having a support member extending from the crown portion to the sole portion, wherein the support member is exposed within the void;

a rear member connected to the body member and received within the void, wherein the rear member has outer surfaces that are contiguous with adjacent outer surfaces of the body member, and wherein the rear member is connected to the body member at a crown end of the support member and at a sole end of the support member, such that the rear member forms portions of a crown and a sole of the head;

at least one connection member connecting the rear member to the support member of the body member in a rigid manner to form a joint between the rear member and the body member, wherein the at least one connection member connects the rear member to the crown end and the sole end of the support member; and a resilient member separating the rear member from the body member, wherein the resilient member engages the rear member and the body member within the void and is positioned between a peripheral edge of the body member defining the void and an opposed edge of the rear member, wherein the resilient member is configured to transfer momentum between the rear member and the body member, wherein the at least one connection member forms a sole area of rigid connection between the rear member and the body member.

19. A wood-type golf club head comprising:

a body member comprising a face having a striking surface configured for striking a ball, a crown portion and a sole portion connected to the face and extending rearward from the face, wherein the body member has a void extending inwardly from a rear periphery of the body member;

a rear member connected to the body member and received within the void, wherein the rear member forms portions of a crown and a sole of the head;

a connection member connecting the rear member to the body member to form a joint between the rear member and the body member;

a resilient member separating the rear member from the body member, wherein the resilient member engages the rear member and the body member within the void and is configured to transfer momentum between the rear member and the body member;

a support member extending from the crown portion to the sole portion proximate a vertex of the void, wherein the support member is exposed within the void, and wherein the connection member connects the rear member to the support member;

wherein the void is angular in shape, such that the void has a vertex proximate a center of the body member and increases in width from the vertex to the rear periphery, and wherein the rear member is wedge-shaped to complement the shape of the void, and wherein the connection member is connected to the body member proximate the vertex, such that the joint is positioned proximate the vertex.

20. The wood-type golf club head of claim 19, wherein the rear member is connected to the body member at a crown end of the support member and at a sole end of the support member.

21. A wood-type golf club head comprising:

a body member comprising a face having a striking surface configured for striking a ball, and a crown portion and a sole portion connected to the face and extending rearward from the face;

a resilient member engaged with a rear portion of the body member;

a rear member connected to the rear portion of the body member and engaged with the resilient member, such that the resilient member separates the rear member from the body member; and a connection member connecting the rear member to the body member to form a joint between the rear member and the body member, wherein the resilient member is configured to transfer momentum between the rear member and the body member, and wherein the body member further comprises an internal support member extending from the crown portion to the sole portion, wherein the connection member connects the rear member to the support member.

22. The wood-type golf club head of claim 21, wherein the head comprises at least one connection member, and wherein the at least one connection member connects the rear member to the body member at a crown end of the support member and at a sole end of the support member, such that the rear member forms portions of a crown and a sole of the head.

23. The wood-type golf club head of claim 22, wherein the at least one connection member comprises a pin extending from the crown end to the sole end of the support member, wherein the pin connects to the rear member at the crown end and the sole end of the support member.

24. The wood-type golf club head of claim 21, wherein a sole end of the support member is positioned closer to the face than a crown end of the support member, such that the support member angles downward and toward the face from the crown end to the sole end.

25. A wood-type golf club head comprising:

a body member comprising a face having a striking surface configured for striking a ball, and a crown portion and a sole portion connected to the face and extending rearward from the face;

a resilient member engaged with a rear portion of the body member;

a rear member connected to the rear portion of the body member and engaged with the resilient member, such that the resilient member separates the rear member from the body member; and an engagement member engaging the rear member and the body member to form a sole area of rigid engagement between the rear member and the body member, wherein the resilient member is configured to transfer momentum between the rear member and the body member, wherein the engagement member is located along a vertical plane extending through a center of the striking surface, and wherein at least a majority of a mass and at least a majority of a surface area of the rear member are located on a heel side of the vertical plane.

26. A wood-type golf club head comprising:

a body member comprising a face having a striking surface configured for striking a ball, and a crown portion and a sole portion connected to the face and extending rearward from the face;

a resilient member engaged with a rear portion of the body member;

a rear member connected to the rear portion of the body member and engaged with the resilient member, such that the resilient member separates the rear member from the body member; and an engagement member engaging the rear member and the body member to form a sole area of rigid engagement between the rear member and the body member, wherein the resilient member is configured to transfer momentum between the rear member and the body member, and wherein the engagement member is located along a vertical plane extending through a center of the striking surface, and wherein at least a majority of a mass and at least a majority of a surface area of the rear member are located on a toe side of the vertical plane.

27. A wood-type golf club head comprising:

a body member comprising a face having a striking surface configured for striking a ball, a crown portion and a sole portion connected to the face and extending rearward from the face, wherein the body member has a void extending inwardly from a rear periphery of the body member;

a rear member connected to the body member and received within the void, wherein the rear member forms portions of a crown and a sole of the head;

a connection member connecting the rear member to the body member to form a joint between the rear member and the body member;

a resilient member separating the rear member from the body member, wherein the resilient member engages the rear member and the body member within the void and is configured to transfer momentum between the rear member and the body member, wherein the connection member is located along a vertical plane extending through a center of the striking surface, and wherein the rear member is symmetrical with respect to the vertical plane.

* * * * *